US005436634A

United States Patent [19]

Kanazawa

[11] Patent Number: 5,436,634

[45] Date of Patent: Jul. 25, 1995

[54] PLASMA DISPLAY PANEL DEVICE AND METHOD OF DRIVING THE SAME

[75] Inventor: Yoshikazu Kanazawa, Kawasaki, Japan

[73] Assignee: Fujitsu Limited, Kawasaki, Japan

[21] Appl. No.: 95,427

[22] Filed: Jul. 23, 1993

[30] Foreign Application Priority Data

Jul. 24, 1992 [JP] Japan ..... 4-198239

[51] Int. Cl.[6] ..... G09G 3/22

[52] U.S. Cl. ..... 345/67; 345/60

[58] Field of Search ..... 345/60, 68, 67

[56] References Cited

U.S. PATENT DOCUMENTS 4,554,537 11/1985 Dick ..... 345/68
4,833,463 5/1989 Dick et al. ..... 345/67
5,049,865 9/1991 Nakamura et al. ..... 345/60

FOREIGN PATENT DOCUMENTS 4-195188 7/1992 Japan .
6-186927 7/1994 Japan .

*Primary Examiner*—Richard Hjerpe
*Assistant Examiner*—Vivian W. Chang
*Attorney, Agent, or Firm*—Staas & Halsey

[57] ABSTRACT

A three-electrode surface-discharge alternating-current plasma display panel (AC PDP) has maintenance discharge electrodes that are in parallel with one another and addressing electrodes that are orthogonal to the maintenance discharge electrodes. The maintenance discharge electrodes are connected to one another, and the maintenance discharge electrodes are independent of one another and correspond to display lines that form a screen of the PDP. Wall charges are accumulated to serve as memory media. Display data are written to the screen in separate two periods, i.e., an addressing period in which wall charges are accumulated according to the display data, to prepare for maintenance discharge (sustain discharge) and a maintenance discharge period in which the maintenance discharge is repeated to emit light. The maintenance discharge in the maintenance discharge period is carried out on every other display line and the accumulation of wall charges in the addressing period is carried out on every display line. This arrangement scans every other display line on the screen according to interlaced display signals (video signals) without producing new display data by line interpolation, thereby shortening an addressing time.

16 Claims, 18 Drawing Sheets

IMAGE

FIELD

NEXT FIELD

IMAGE

FIELD

NEXT FIELD

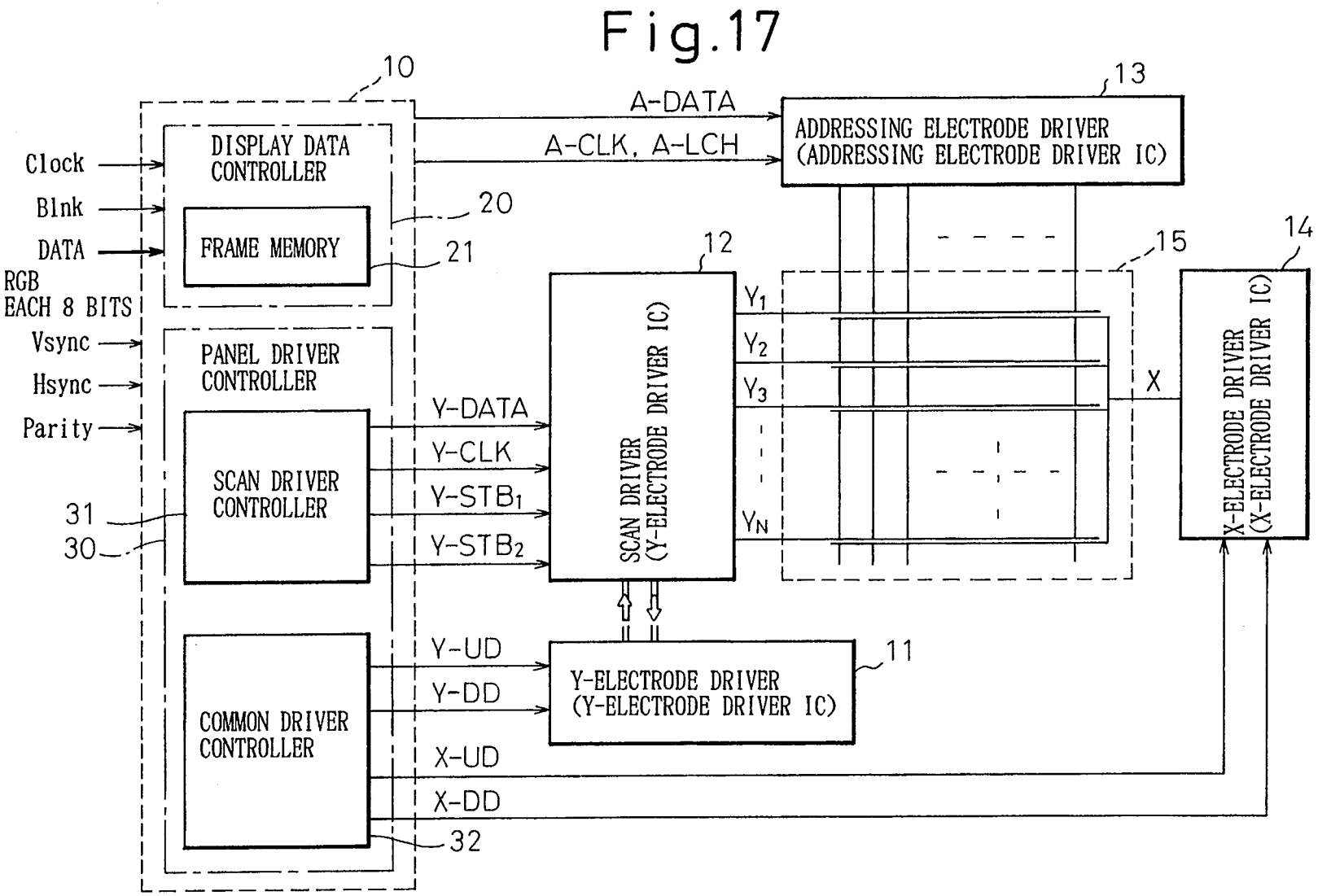
Fig.17
ADDRESSING ELECTRODE DRIVER
(ADDRESSING ELECTRODE DRIVER IC)
13
X-ELECTRODE DRIVER
(X-ELECTRODE DRIVER IC)
14
15
X
Y1
Y2
Y3
YN
SCAN DRIVER
(Y-ELECTRODE DRIVER IC)
12
Y-ELECTRODE DRIVER
(Y-ELECTRODE DRIVER IC)
11
A-DATA
A-CLK, A-LCH
Y-DATA
Y-CLK
Y-STB1
Y-STB2
Y-UD
Y-DD
X-UD
X-DD
10
20
21
32
DISPLAY DATA
CONTROLLER
FRAME MEMORY
PANEL DRIVER
CONTROLLER
SCAN DRIVER
CONTROLLER
COMMON DRIVER
CONTROLLER
Clock
Blnk
DATA
RGB
EACH 8 BITS
Vsync
Hsync
Parity
31
30

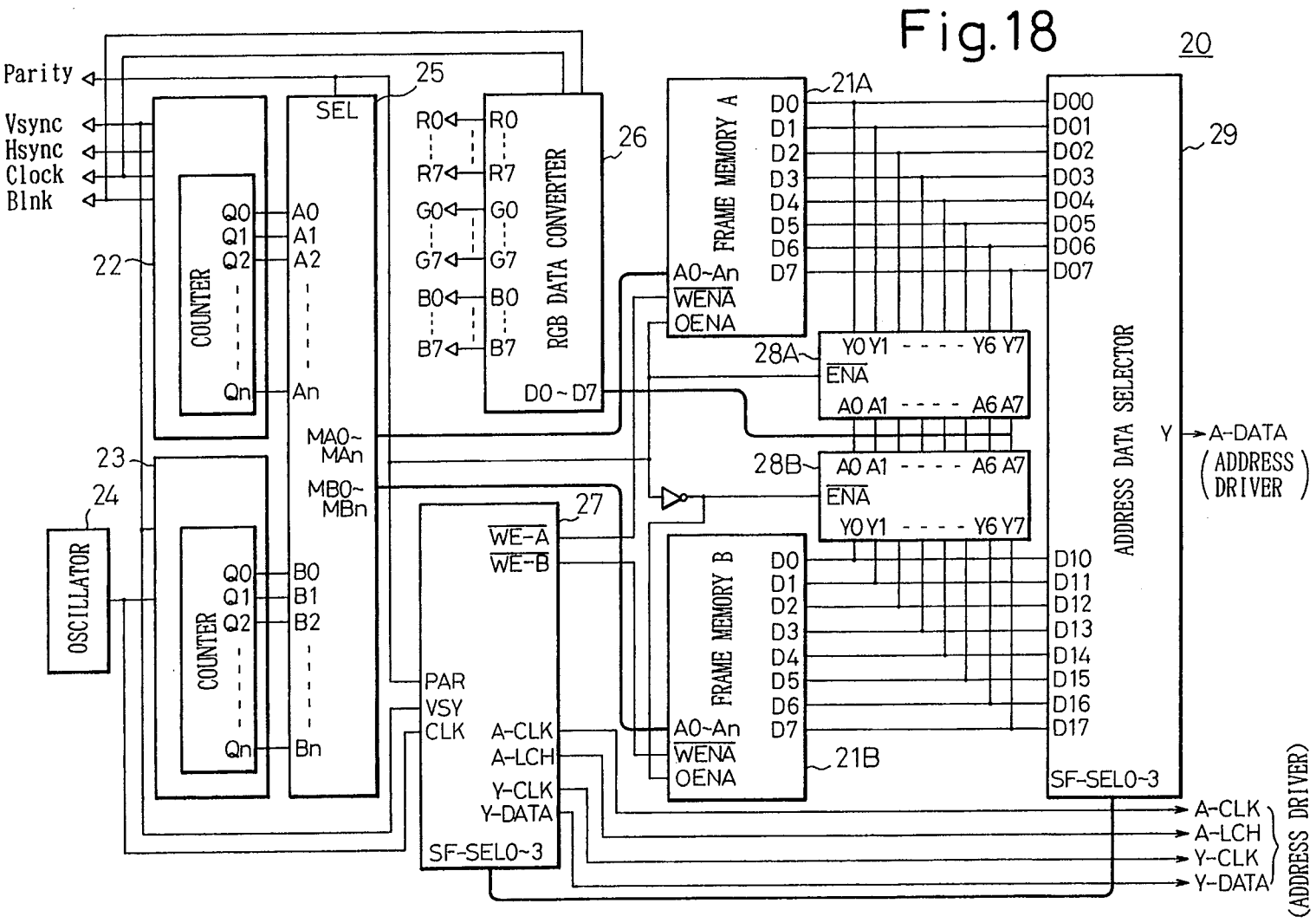
Fig.18
20
29
ADDRESS DATA SELECTOR
D00 D01 D02 D03 D04 D05 D06 D07
D10 D11 D12 D13 D14 D15 D16 D17
SF-SEL0~3
Y
A-DATA
(ADDRESS DRIVER)
A-CLK
A-LCH
Y-CLK
Y-DATA
(ADDRESS DRIVER)
21A
FRAME MEMORY A
D0 D1 D2 D3 D4 D5 D6 D7
A0~An
WENA
OENA
28A
Y0 Y1 - - - - Y6 Y7
ENA
A0 A1 - - - - A6 A7
28B
A0 A1 - - - - A6 A7
ENA
Y0 Y1 - - - - Y6 Y7
21B
FRAME MEMORY B
D0 D1 D2 D3 D4 D5 D6 D7
A0~An
WENA
OENA
26
RGB DATA CONVERTER
D0~D7
R0 - - - R7 G0 - - - G7 B0 - - - B7
R0 - - - R7 G0 - - - G7 B0 - - - B7
27
WE-A
WE-B
A-CLK
A-LCH
Y-CLK
Y-DATA
SF-SEL0~3
PAR
VSY
CLK
25
SEL
A0 A1 A2 - - - - - An
MA0~MAn
MB0~MBn
B0 B1 B2 - - - - - Bn
COUNTER
Q0 Q1 Q2 - - - - - Qn
COUNTER
Q0 Q1 Q2 - - - - - Qn
22
23
24
OSCILLATOR
Parity
Vsync
Hsync
Clock
Blnk

PLASMA DISPLAY PANEL DEVICE AND METHOD OF DRIVING THE SAME

BACKGROUND OF THE INVENTION

1. Field of the Invention

The present invention relates to a plasma display panel device and a method of driving the same and, more particularly, to a three-electrode surface-discharge alternating-current plasma display panel (AC PDP) device and a method of driving the AC PDP.

2. Description of the Related Art Flat display panels such as AC PDPs are required to have large screens, large capacity, and the ability to display full-color images. In particular, the AC PDPs are required to provide more display lines and intensity levels and stably rewrite their screens without decreasing the luminance of the screens. It is also required to provide a method of driving such AC PDPs. Another requirement is to provide a PDP driving method that is suitable for processing interlaced signals for television images.

Conventional PDP driving methods are disclosed in, for example, Japanese Patent Application (JPA) No. 2-331589 (Japanese Unexamined Patent Publication No. 4-1915188) and JPA No. 3-338342 (Japanese Unexamined Patent Publication (Kokai) No. 6-186927). These conventional methods will be explained later.

SUMMARY OF THE INVENTION

To meet these requirements for PDPs and PDP driving methods, an object of the present invention is to provide a PDP device and a PDP driving method that are capable of reducing addressing operations, increasing subfields, intensity levels, scan lines, and maintenance discharge pulses, to enlarge the panel size and improve luminance, and expanding each drive cycle, to achieve stabilized operation. Another object of the present invention is to provide a low-cost PDP driver that is capable of displaying images on a PDP according to interlaced signals without line interpolation and without circuits and frame memories for the line interpolation.

According to the present invention there is provided a method of driving a three-electrode surface-discharge alternating-current plasma display panel having first and second maintenance discharge electrodes that are in parallel with one another and addressing electrodes that are orthogonal to the first and second maintenance discharge electrodes, the first maintenance discharge electrodes being connected to one another, the second maintenance discharge electrodes being independent of one another and corresponding to display lines that form a screen of a plasma display panel, and wall charges being accumulated to serve as memory media, wherein the method comprises the steps of writing display data to the screen in separate first and second periods, the first period being determined to be an addressing period in which wall charges are accumulated according to the display data to prepare for maintenance discharge, and the second period being determined to be a maintenance discharge period in which the maintenance discharge is repeated to emit light, and carrying out the accumulation of wall charges in the addressing period on every other display line and the maintenance discharge in the maintenance discharge period on every display line.

The method may further comprise the steps of dividing a frame, which corresponds to the screen, into first and second fields, and selectively writing display data to odd display lines in each addressing period in the first field and to even display lines in each addressing period in the second field. The method may further comprise the steps of storing display data in a memory unit during the first field and, during the second field, reading the display data out of the memory unit and also writing the read data in discharge cells, and storing display data in the memory unit during the second field, and, during a first field of the next frame, reading the display data out of the memory unit and writing the read data in the discharge cells.

The method may further comprise the steps of writing, in the first field, display data in discharge cells and carrying out maintenance discharge in the first and second fields according to the written display data, and writing, in the second field, display data in the discharge cells and carrying out maintenance discharge in the second field and a first field of the next frame according to the written display data. In every display line, the phase of a maintenance discharge voltage applied in each maintenance discharge period in the first field may be the same as the phase of a maintenance discharge voltage applied in each maintenance discharge period in the second field.

The maintenance discharge may be carried out with the same maintenance discharge driver in the first and second fields, and the number of applications of the maintenance discharge voltage in the first field may be the same as that in the second field. The method may further comprise the step of applying an erase pulse to carry out erase discharge only on the even or odd display lines, to provide the even and odd display lines with different numbers of maintenance discharge operations.

The first field may include subfields except a subfield having the highest luminance, and the second field may cover the maintenance discharge periods of the subfield having the highest luminance.

According to the present invention there is also provided a three-electrode surface-discharge alternating-current ("AC") plasma display panel device comprising first and second maintenance discharge electrodes provided in parallel with one another, the first maintenance discharge electrodes being connected to one another, the second maintenance discharge electrodes being independent of one another and corresponding to display lines that form a screen of a plasma display panel, and wall charges being accumulated to serve as memory media; addressing electrodes provided orthogonal to the first and second maintenance discharge electrodes; a unit for writing display data to the screen in separate first and second periods, the first period being determined to be an addressing period in which wall charges are accumulated according to the display data to prepare for maintenance discharge, and the second period being determined to be a maintenance discharge period in which the maintenance discharge is repeated to emit light; and a unit for carrying out the accumulation of wall charges in the addressing period on every other display line and the maintenance discharge in the maintenance discharge period on every display line.

BRIEF DESCRIPTION OF THE DRAWINGS

The present invention will be more clearly understood from the description of the preferred embodiments as set forth below with reference to the accompanying drawings, wherein:

FIG. 17 is a block diagram showing a PDP according to the present invention;

FIG. 18 is a block diagram showing a display data controller of the PDP of FIG. 17;

DESCRIPTION OF THE PREFERRED EMBODIMENTS

For a better understanding of the preferred embodiments of the present invention, the problems of the prior art will be explained with reference to FIGS. 1 and 2.

Figure 1:
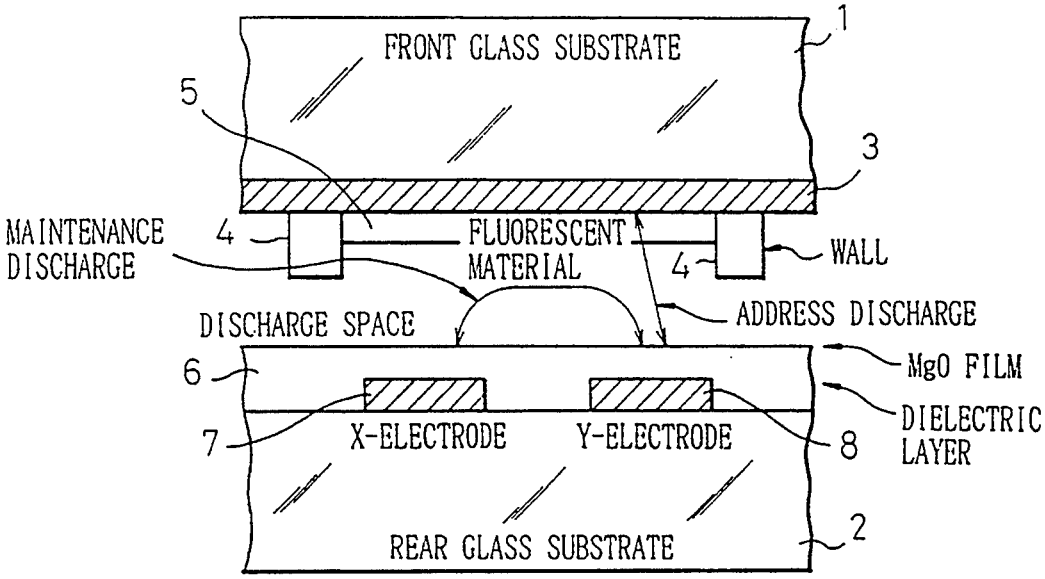
Fig.1 PRIOR ART
FIGS. 1 and 2 show a structure of an AC PDP.
Figure 2:
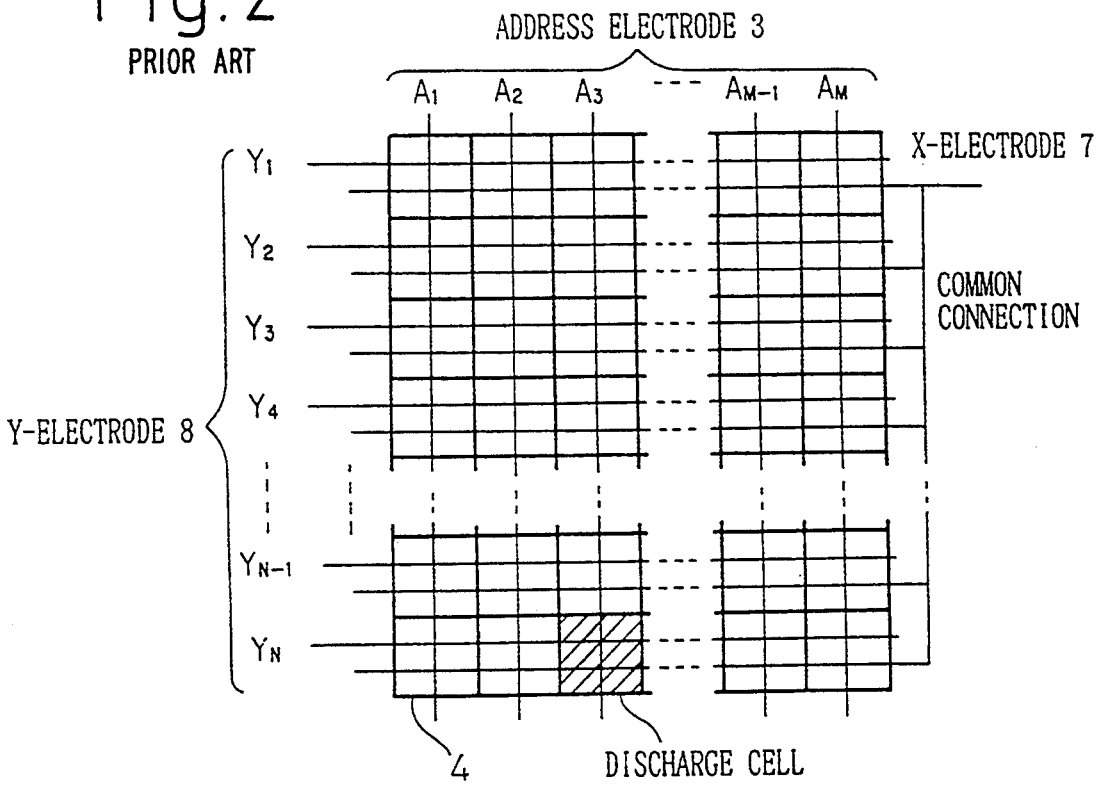
Fig.2 PRIOR ART

FIGS. 1 and 2 show an arrangement of a three-electrode surface-discharge AC PDP (alternating-current plasma display panel), in which FIG. 1 shows a section of the AC PDP and FIG. 2 shows electrodes and M×N dots of the AC PDP.

In FIG. 1, numeral 1 is a front glass substrate, 2 is a rear glass substrate, 3 is an addressing electrode, 4 is a wall 5 is a fluorescent material (phosphor), deposited between the walls, 6 is a dielectric layer, and 7 and 8 are X- and Y-electrodes serving as maintenance electrodes. Discharge (sustain discharge) is mainly carried out between the X-electrodes (first maintenance discharge electrodes) 7 and the Y-electrodes (second maintenance discharge electrodes) 8. To select pixels (cells) according to display data, the addressing electrodes 3 corresponding to the cells to be selected are selected to cause discharge (address discharge) against ,one of the Y-electrodes 8 that corresponds to the cells. The dielectric layer 6 serves as an insulation layer and is formed over the maintenance discharge electrodes 7 and 8. A protective MgO film is formed over the dielectric layer 6. Facing these layers, the front glass substrate 1 has the addressing electrodes 3 and fluorescent material 5.

The walls 4 are formed on one or both of the glass substrates 1 and 2, to define discharge spaces. Each of the discharge spaces defines a cell (pixel) to cause discharge. When the discharge occurs, ultraviolet rays are produced to make the fluorescent material (phosphor) 5 emit light. FIG. 2 shows a matrix of M×N cells that form a display screen. Reference marks A1 to AM represent the addressing electrodes 3 and Y1 to YN represent Y-electrodes 8. The X-electrodes 7 are connected to one another.

Figure 3:
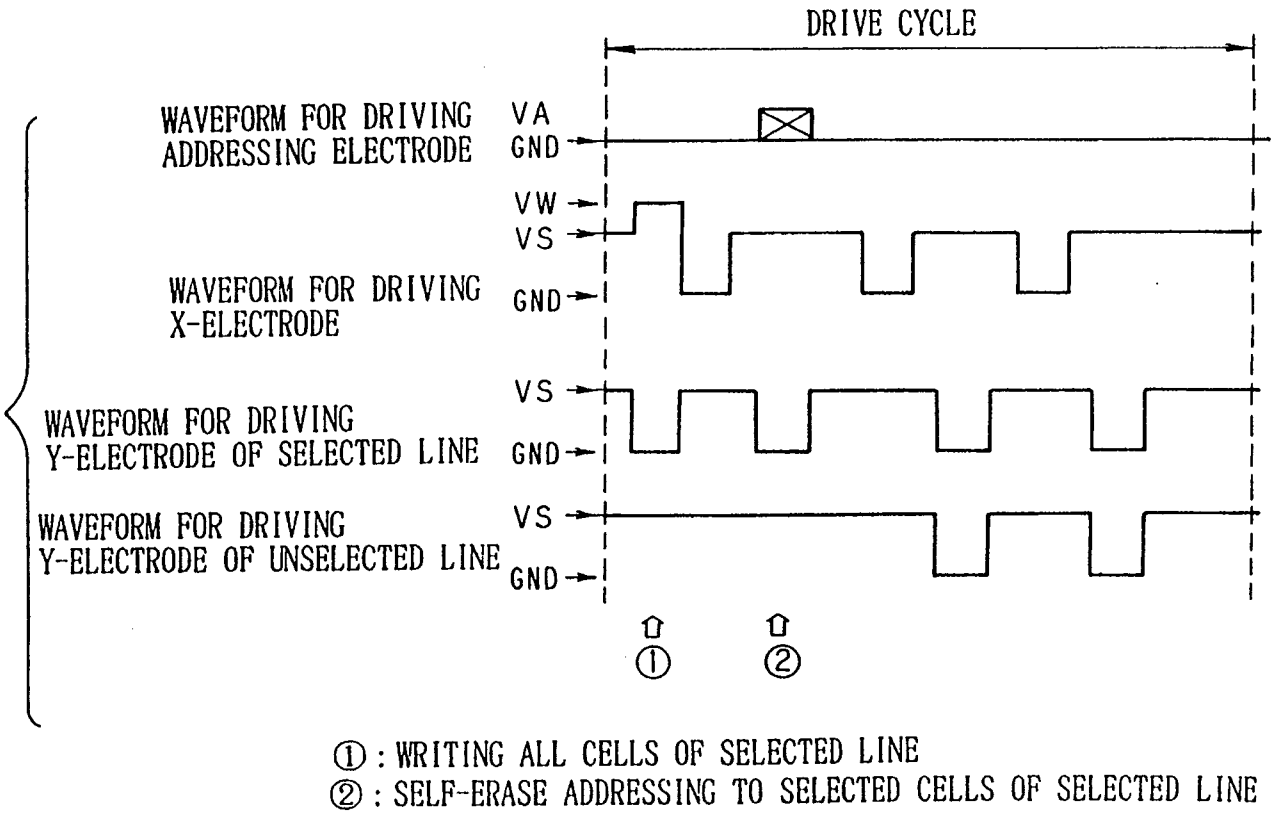
Fig. 3 PRIOR ART
FIG. 3 shows examples of basic waveforms for driving the PDP according to a self-erase addressing method.

FIG. 3 shows examples of basic waveforms for driving the PDP according to a self-erase addressing method. A positive write pulse having a voltage of Vw is applied to the X-electrodes 7. At the same time, one of the Y-electrodes 8 corresponding to a selected display line is set to a ground level GND, and the remaining Y-electrodes 8 corresponding to unselected display lines are set to a level of Vs. As a result, a voltage between the X-electrode 7 and the Y-electrode 8 of the selected display line becomes Vw, and a voltage between the X-electrodes 7 and the Y-electrodes 8 of the unselected display lines becomes Vw-Vs. These voltages are Set as $Vw > Vf$ (Vf: firing voltage; a discharge start voltage) and $Vf >> Vw - Vs$. Accordingly, all cells of the selected display line start to discharge. As the discharge progresses, negative wall charges accumulate on the MgO film on the X-electrode 7, and positive wall charges accumulate on the MgO film on the Y-electrode 8 of the selected display line. The polarities of these wall charges cause a voltage in each discharge space to drop, to end the discharge within about one microsecond.

An alternating voltage of Vs is applied to the X- and Y-electrodes 7 and 8. At each alternation, the accumulated wall charges are enhanced by the applied voltage, and therefore, the effective voltage of the wall charges exceeds the discharge start voltage Vf, to thereby repeat maintenance discharge.

For cells to be erased in the selected display line, maintenance discharge is carried out to accumulate positive wall charges on the MgO film on the X-electrode 7 and negative wall charges on the MgO film on the Y-electrode 8. Then, a positive addressing pulse having a voltage of Va is applied to the addressing electrodes 3 corresponding to the cells to be erased, and the Y-electrode 8 of the selected display line is set to GND. This causes a maintenance discharge in all cells of the selected display line. At this time, the cells that have received the addressing pulse cause an additional discharge between the addressing electrodes 3 and the Y-electrode 8, to accumulate excessive wall charges on the MgO film on the Y-electrode 8. If the voltage Va is set such that the voltage of the excessively accumulated wall charges exceeds the firing voltage (discharge start voltage) Vf, these wall charges start a self-erase discharge to erase themselves in each of the cells to be erased, as soon as the external voltages are removed, i.e., as soon as the X- and Y-electrodes 7 and 8 are returned to Vs and the addressing electrodes 3 to GND. The other cells that have not received the addressing pulse never cause the self-erase discharge, and therefore, undergo maintenance discharges in response to maintenance discharge pulses applied afterwards. This method of selecting cells is called the self-erase addressing method.

The above explanation relates to a sequential line driving technique, which sequentially selects display lines one by one and carries out a write operation and a self-erase addressing operation on cells of the selected display line.

Figure 4:
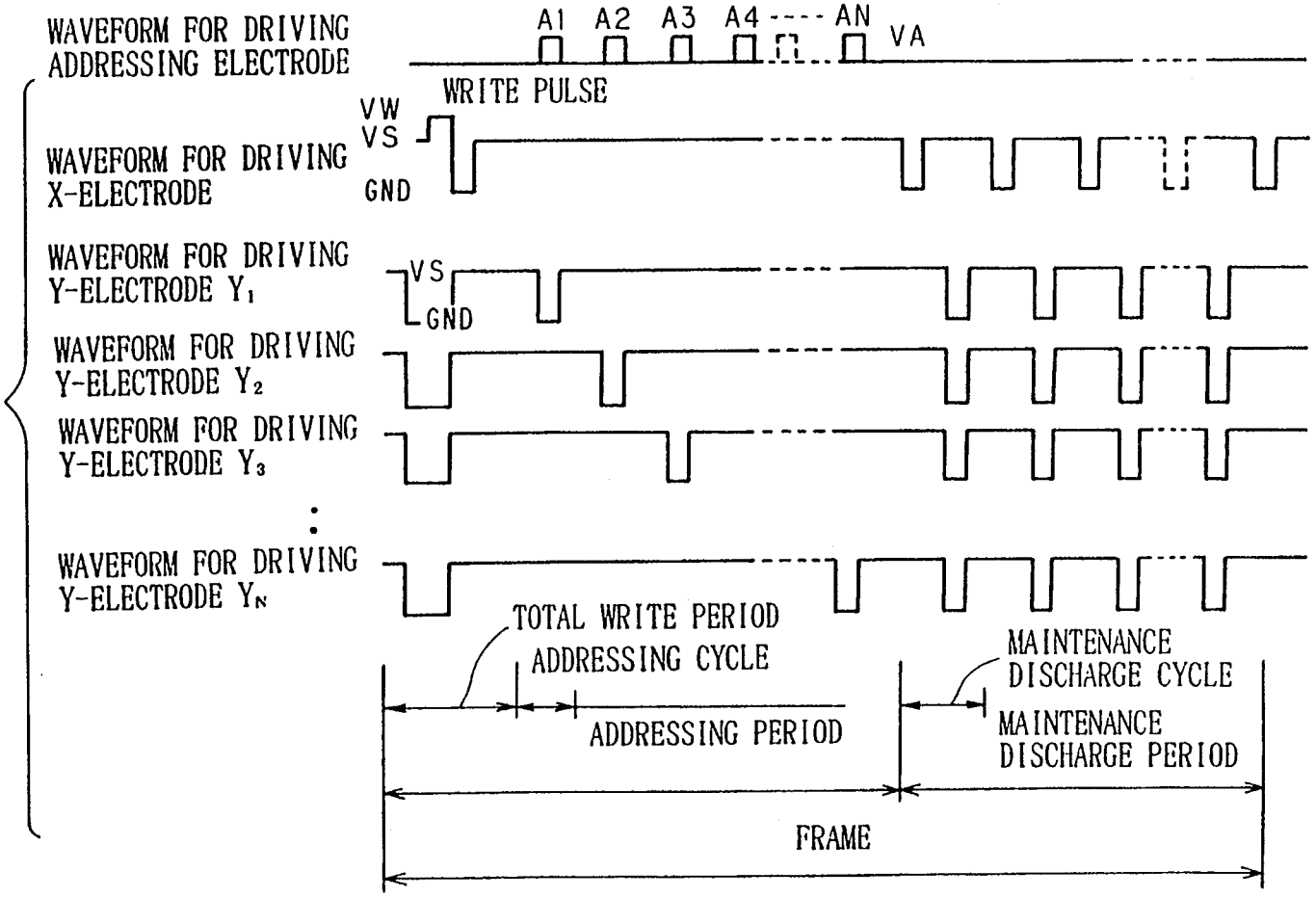
Fig. 4 PRIOR ART
FIG. 4 shows examples of other basic waveforms for driving the PDP according to the self-erase addressing method.

FIG. 4 shows basic waveforms for driving the PDP according to another driving method employing a total write period, a self-erase addressing period, and a maintenance discharge period (sustain discharge period). These-periods are temporally separated from one another to write display data in an entire screen.

Write discharge and maintenance discharge (sustain discharge) are carried out in all display lines, i.e., in all cells of a screen. Thereafter, the Y-electrodes 8 corresponding to display lines are sequentially selected by setting them one-by-one to a potential level of GND. An addressing pulse is applied to cells to be erased in the selected display line according to display data, to carry out a self-erase addressing operation in the selected display line. The self-erase addressing operation is repeated on all display lines, to extinguish wall charges of the cells that carry out no maintenance discharge. Thereafter, maintenance discharge pulses (sustain discharge pulses) are applied to repeat maintenance discharge in cells that keep wall charges. This technique may be employed for a display panel involving many scan lines or a display panel for displaying full-color images with multiple intensity levels. (Refer to Japanese Patent Application No. 2-331589 and Japanese Unexamined Patent Publication No. 4-195188.)

Figure 5:
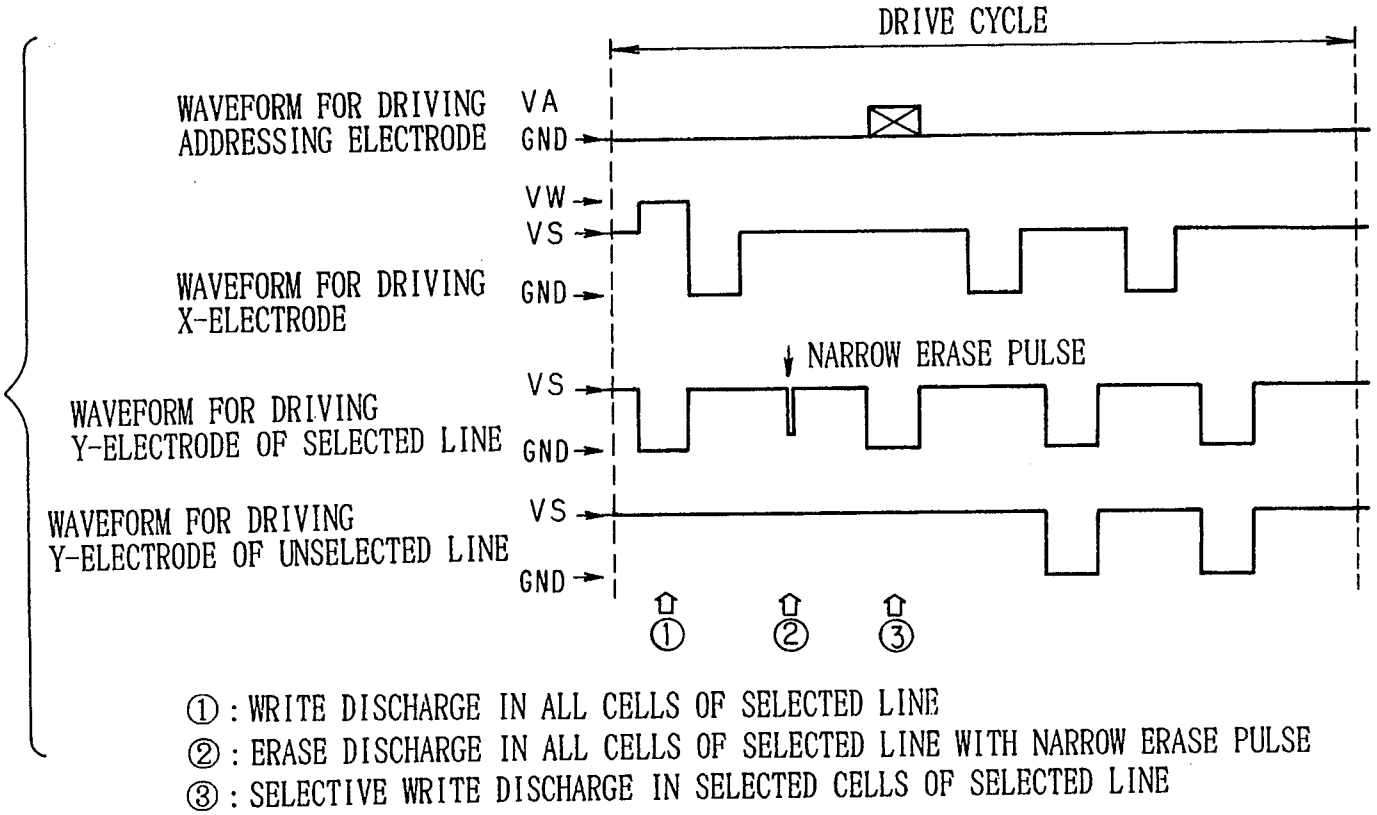
FIG. 5 shows examples of basic waveforms for driving the PDP according to a selective write addressing method.

The above examples write display data according to the self-erase addressing method during an addressing period. There is another method called a selective write addressing method (Japanese Patent Application No. 3-338342 and Japanese Unexamined Patent Publication No. 6-18692). FIG. 5 shows examples of basic waveforms for driving the PDP according to this method.

Figure 6:
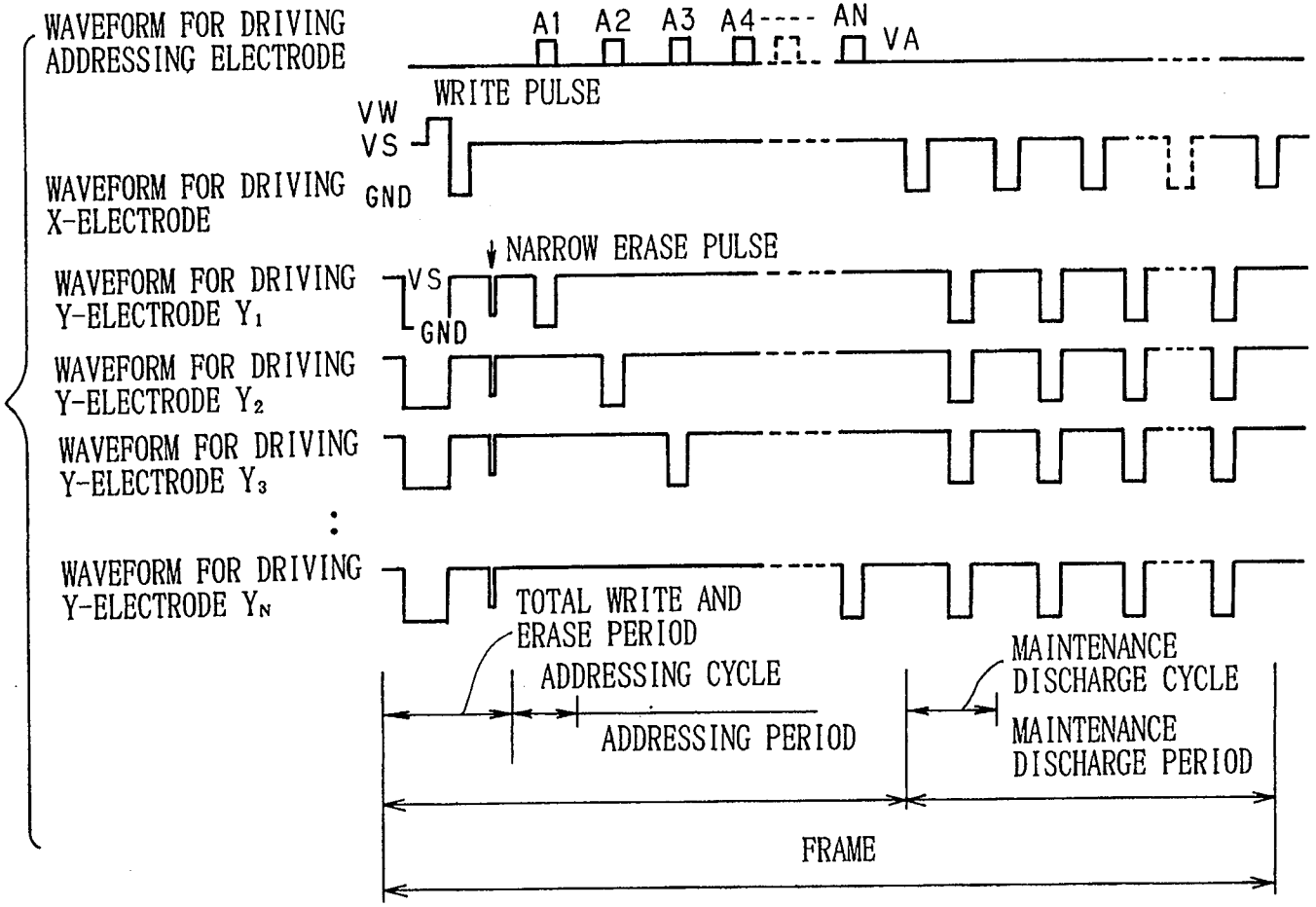
FIG. 6 shows examples of other basic waveforms for driving the PDP according to the selective write addressing method.

In FIG. 5, the selective write addressing method writes all cells of a selected display line and then erases these cells. Thereafter, the method writes data to selected cells of the selected display line according to display data. FIG. 6 shows waveforms for driving a PDP according to the elective write addressing method with a separate addressing period and maintenance discharge period.

Figure 7:
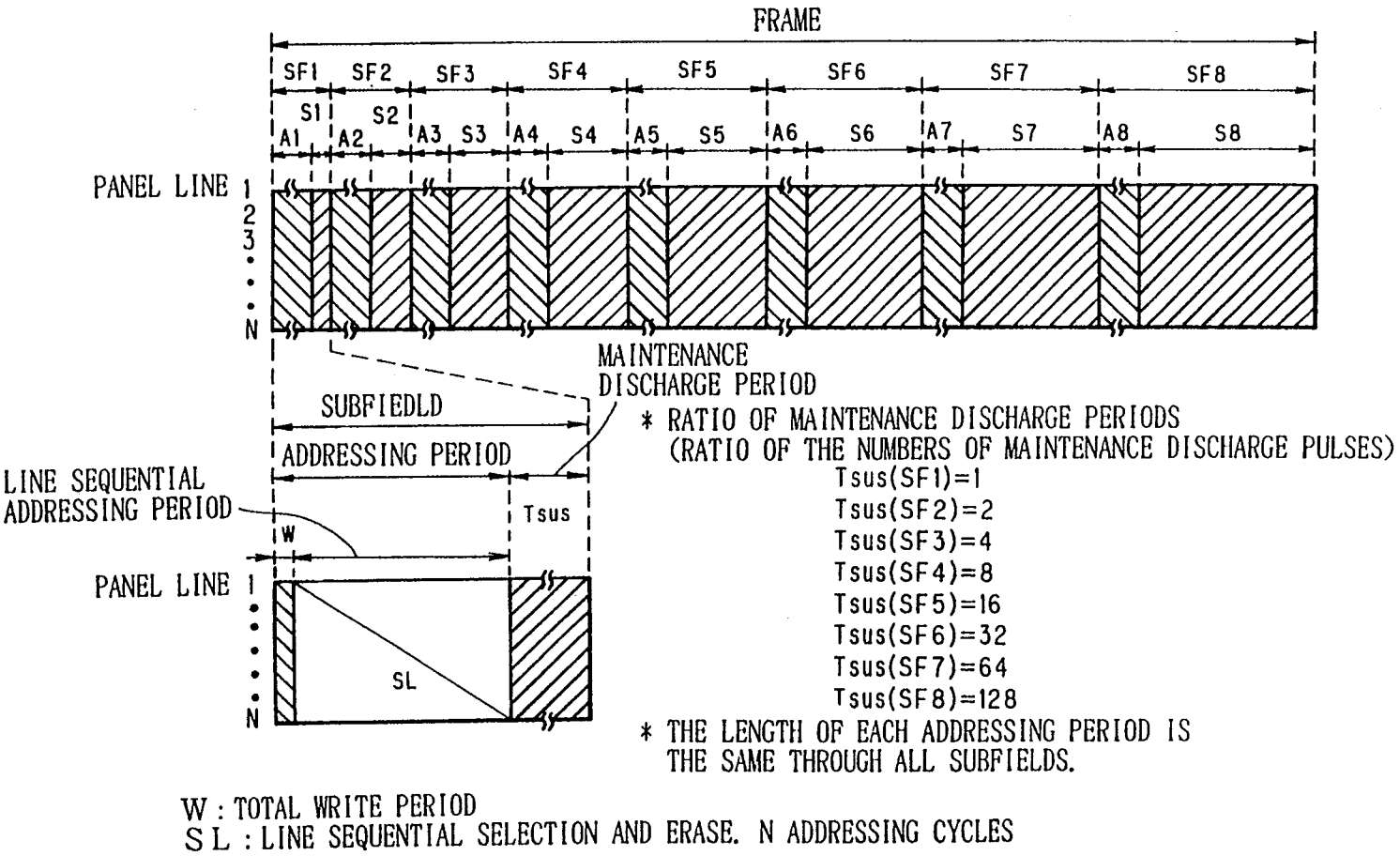
Fig. 7 PRIOR ART
FIG. 7 is a timing chart explaining a conventional method for driving the PDP.

FIG. 7 is a timing chart explaining an example of a conventional PDP driving method to achieve 256 intensity levels.

In FIG. 7, a frame is divided into eight subfields SF1 to SF8. Each of the subfields involves a total write period W, a sequential line addressing period SL, and maintenance discharge periods S1 to S8. The number of maintenance discharge operations carried out in the periods S1 to S8 differ from subfield to subfield, and a ratio of the maintenance discharge operations is 1:2:4:8:16:32:64:128. The number of the maintenance discharge operations corresponds to the number of intensity levels. Selecting some of the subfields to emit light will select one of the 256 intensity levels ranging from 0 to 255.

Eight subfields are required to provide 256 intensity levels. Generally, displaying high-quality images requires 256 intensity levels. A television display method such as an NTSC method requires 64 or more intensity levels. To increase the number of intensity levels, the number of maintenance discharge operations must be increased.

Before starting a display frame, display data for all display lines of the frame must be ready. A display controller, therefore, has a frame memory for storing the display data. The display data stored in the frame memory are usually rewritten frame by frame. The capacity of the frame memory, therefore, must cover all display lines of the frame.

As explained above, many addressing cycles and subfields are required to provide many display lines and intensity levels. The period of each frame is prescribed as, for example, 16.7 msec (with a frame frequency ranging from 50 to 70 Hz, 1/60 Hz=16.7 msec). Within this limited period, all necessary operations must be completed. To secure stable operations, each driving cycle must be sufficiently long. For example, a maintenance discharge pulse must have a period of about 3 to 5 μsec. To increase luminance, many maintenance discharge cycles (periods) must be prepared. Presently available AC PDPs require, a maintenance discharge frequency of about 30 KHz. To increase the number of intensity levels, the number of subfields must be increased. According to the conventional PDP driving method, each display line must involve an addressing cycle. Due to these conditions, it is very difficult to increase the size of a screen, the level of luminance, and the number of intensity levels.

When the display lines of a screen are sequentially driven within each frame to rewrite display images according to interlaced display data such as television image signals sent from a host, it is necessary to carry out line interpolation to supplement display data for lines that are absent in each field. This may be achievable by inter-frame-interpolation or inter-field interpolation. Any of these techniques requires additional circuits.

FIGS. 8A to 8D and 9A to 9D explain processes of converting interlaced scanning into sequential scanning by line interpolation, in which FIGS. 8A to 8D show conversion processes for a still image and FIGS. 9A to 9D show conversion processes for a moving image.

When the size of a display unit such as a CRT or PDP becomes larger, line flickering or slight vertical fluctuations in scan lines will occur due to interlaced scanning. This results in showing vertical thin straight lines to be zigzagging. To prevent this kind of deterioration in the quality of images, the interlaced scanning is usually converted into sequential scanning (non-interlaced scanning).

Figure 8A:
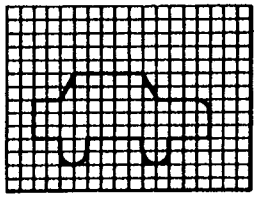
Fig. 8A PRIOR ART
FIGS. 8A to 8D and 9A to 9D explain processes of converting interlaced scanning into sequential scanning by line interpolation.
Figure 8B:
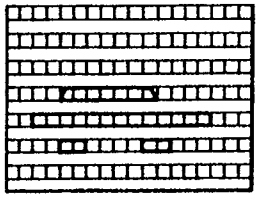
Fig. 8B PRIOR ART
Figure 8C:
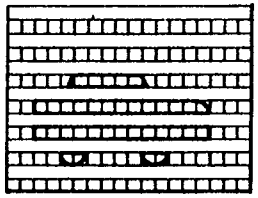
Fig. 8C PRIOR ART
Figure 8D:
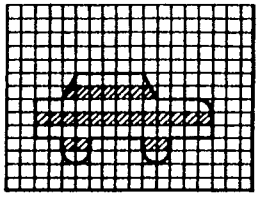
Fig. 8D PRIOR ART

To convert an interlaced still image into a non-interlaced image, image signals of FIG. 8A are converted into digital signals by an analog-to-digital (A/D) converter. Image data of a field shown in FIG. 8B is stored in an image memory. The stored data is combined with image data of the next field shown in FIG. 8C, and the combined data are displayed as shown in FIG. 8D.

Figure 9A:
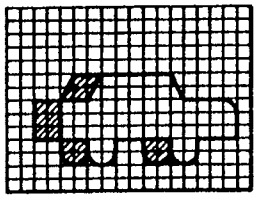
Fig. 9A PRIOR ART
Figure 9B:
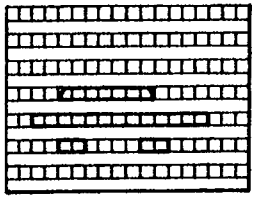
Fig. 9B PRIOR ART
Figure 9C:
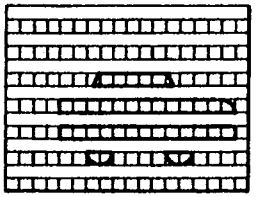
Fig. 9C PRIOR ART
Figure 9D:
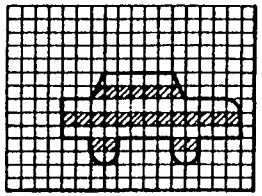
Fig. 9D PRIOR ART

When an image is moving at high speed, the processes of FIGS. 8A to 8D will provide overlapping images with blurred contours. To avoid this, the processes of FIGS. 9A to 9D generate interpolation signals for absent scan lines from adjacent scan lines in the same field. For example, the image of a car shown in FIG. 9A moves forward two units between fields. In this case, the image data of the field of FIG. 8B cannot be combined with the image data of the next field of FIG. 8C. Accordingly, when a movement detector detects the movement, interpolation signals for absent scan lines are generated as shown in FIG. 9C according to adjacent scan lines in the same field, and the interpolated image is displayed as shown in FIG. 9D.

The movement detector determines whether an image is static or moving by dividing a screen into small sections and comparing a present field with a second previous field. If the image is static, interpolation signals are obtained from a first previous field, and if the image is moving, interpolation signals are generated from adjacent scan lines in the same field. In this way, this method, which is called a movement adaptive scan interpolation method, provides an optimum non-interlaced image depending on the movement of a fraction of screen data. To convert an interlaced image into a non-interlaced image, the horizontal scanning frequency of the interlaced scanning must be doubled (15.75 KHz×2=31.5 KHz) with the use of a line memory.

Figure 10:
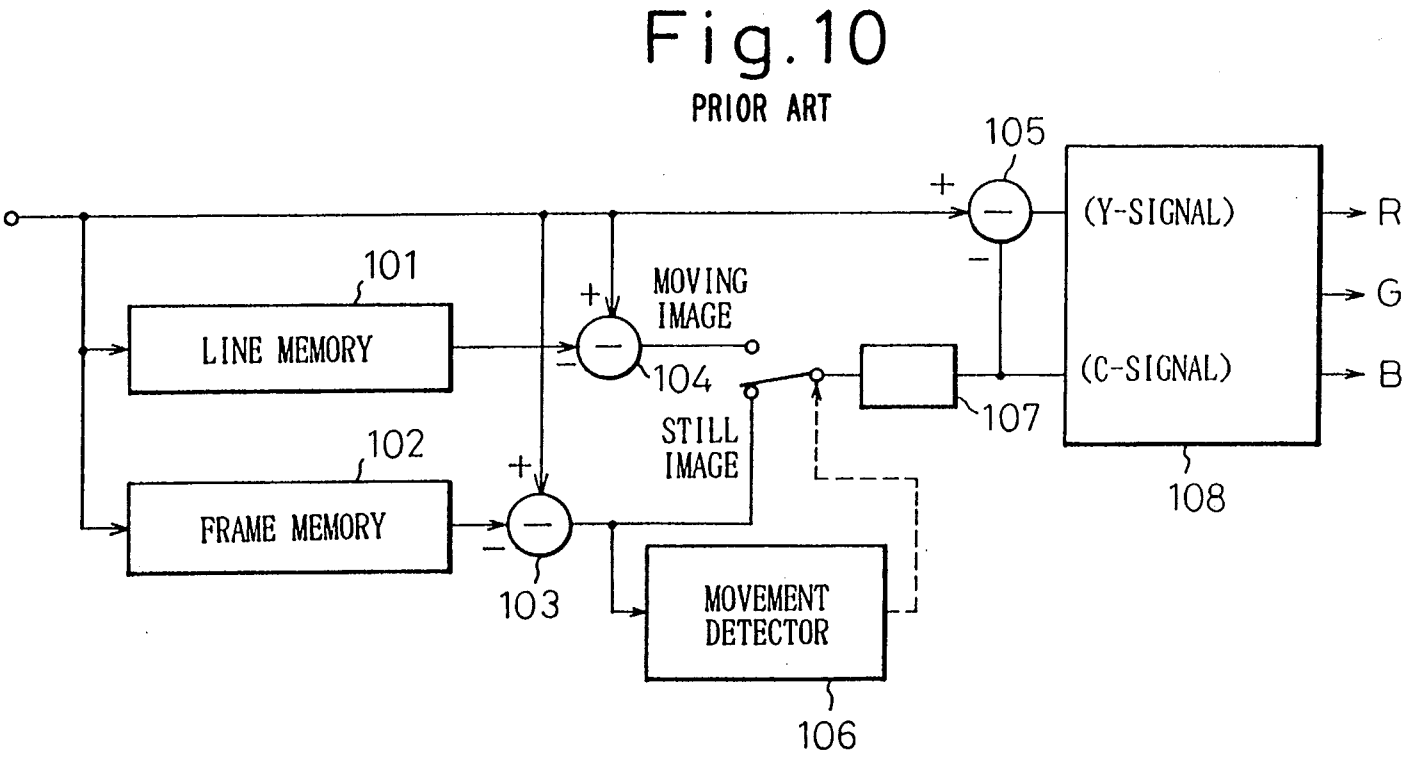
Fig.10 PRIOR ART
FIG. 10 shows an example of a movement adaptive YC separate circuit.

FIG. 10 shows an example of a movement adaptive YC separation circuit. In the figure, numerals 101 and 102 are one-line frame memories, 103, 104, and 105 are adders (subtracters), 106 is a movement detector, 107 is a band-pass filter, and 108 is an RGB generator.

Generally, a luminance signal Y is separated from a carrier chrominance signal C by a comb filter employing a 1H delay element. A 1H-delayed luminance signal does not always have the same phase as the next 1H luminance signal, and thus it is impossible to completely separate the luminance signal Y from the carrier chrominance signal C. This results in causing cross color interference and dot interference. These problems are substantially completely eliminated by the movement adaptive YC separation circuit of FIG. 10. The separated signals Y and C are provided to the RGB generator 108, which provides red (R), green (G), and blue (B) signals.

Now, a PDP driving method according to an embodiment of the present invention will be explained with reference to the drawings.

This method drives a three-electrode surface-discharge AC PDP having maintenance discharge electrodes 7 and 8 that are in parallel with one another and addressing electrodes 3 that are orthogonal to the maintenance discharge electrodes 7 and 8. The maintenance discharge electrodes 7 are connected to one another, and the maintenance discharge electrodes 8 are independent of one another and correspond to display lines, respectively. Wall charges are accumulated to serving as memory media. Display data are written to a screen of the PDP in two separate periods, i.e., an addressing period in which wall charges are accumulated according to the display data, thereby to prepare for maintenance discharge, and a maintenance discharge period in which the maintenance discharge is repeated, thereby to emit light. The maintenance discharge according to the display data during the maintenance discharge period and the accumulation of wall charges according to the display data during the addressing period are carried out on every other display line.

This method drives the PDP in separate addressing and maintenance discharge periods and carries out the sequential accumulation of wall charges during the addressing period and the maintenance discharge during the maintenance discharge period on every other display line.

Namely, the PDP driving method of the present invention writes display data to every other display line during the addressing period. More precisely, the method divides a frame, which corresponds to a screen involving all the display lines, into first and second fields each having at least one subfield. During an addressing period in each subfield in the first field, odd display lines are rewritten, and, during an addressing period in each subfield in the second field, even display lines are rewritten. Namely, half of the display lines are rewritten in each addressing period.

After each of the addressing periods, maintenance discharge is carried out in both fields by applying a maintenance discharge voltage whose phase is the same through all the display lines. A ratio of the lengths of the maintenance discharge periods, i.e., a ratio of the numbers of maintenance discharge operations carried out in the periods is, for example, 1:2:3:4:8:16:32:64:127 so as to provide 255 intensity levels, if each field contains eight subfields.

In this way, the PDP driving method according to the present invention halves the number of display lines reduced to be rewritten in each addressing period, to thereby shorten an addressing time.

This results in providing each driving cycle with a sufficient length to stabilize the operation of the PDP, increasing maintenance discharge cycles to improve luminance, and expanding the number of subfields to increase the number of intensity levels.

Since the quantity of display data to be written in a memory in each field is halved, the capacity of the memory for storing the display data can be halved. Since input signals (display data) are displayed as they are, circuits for line interpolation can be omitted.

Figure 11:
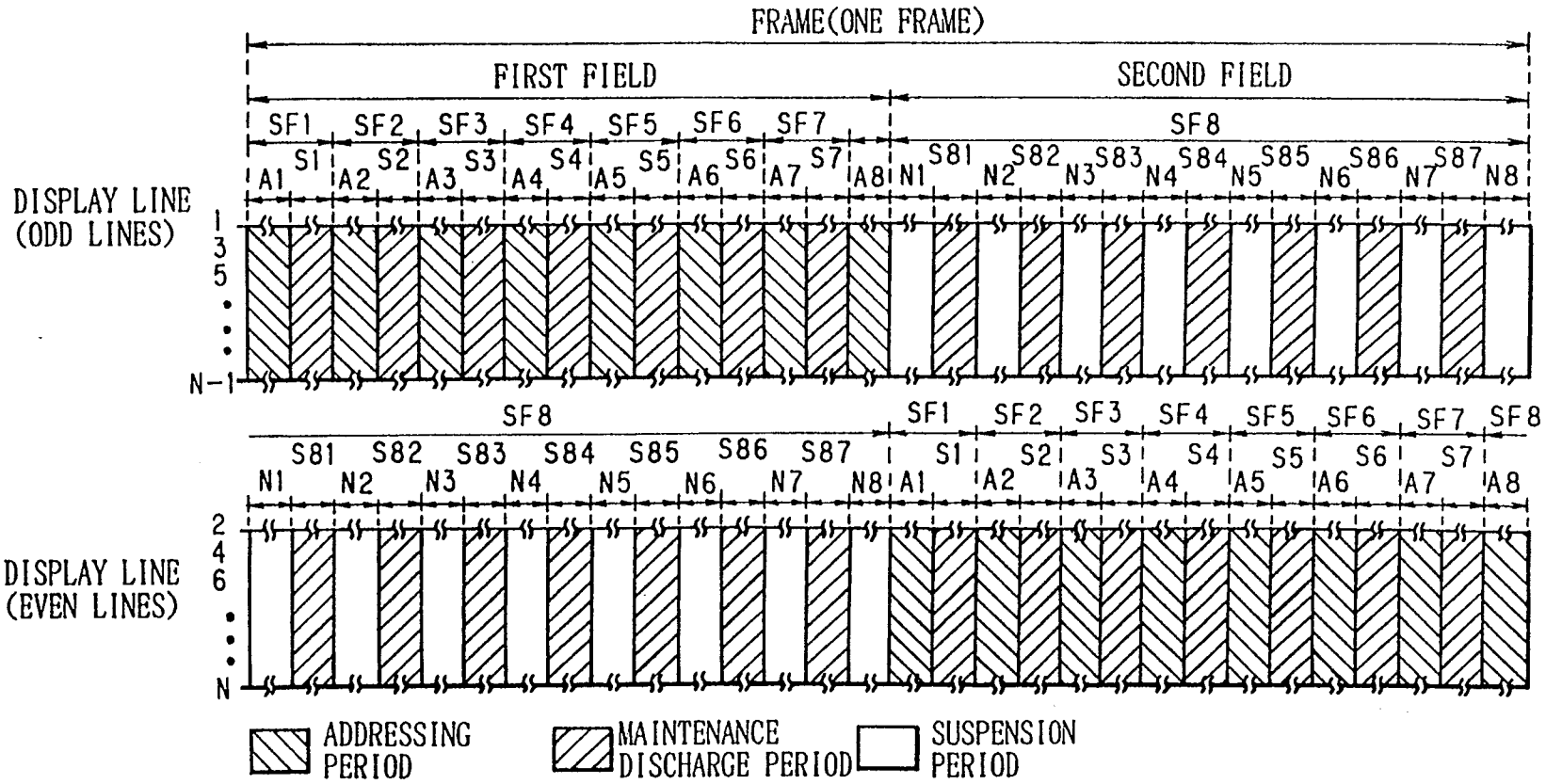
FIG. 11 is a timing chart explaining a PDP driving method according to an embodiment of the present invention.

FIG. 11 is a timing chart explaining the PDP driving method according to the embodiment of the present invention. In the figure, a frame is divided into a first field F1 and a second field F2. Different subfields, which produce intensity levels, are allocated for odd and even display lines. Namely, this embodiment sequentially forms wall charges according to display data during addressing periods and carries out maintenance discharge according to the display data during maintenance discharge periods in an interlaced mode.

For the odd display lines shown in FIG. 11, the first field F1 involves subfields SF1 to SF7 and an addressing period A8 of a subfield SF8 of the second field F2, and the second field F2 involves only maintenance discharge periods S81 to S87 of the subfield SF8. These periods S81 to S87 for the odd display lines are the same as maintenance discharge periods S1 to S7 in subfields SF1 to SF7 for the even display lines. While the odd display lines are being addressed in addressing periods Al to A8 in the subfields SF1 to SF8, nothing is carried out on the even display lines.

Similarly, for the even display lines, the second field F2 involves subfields SF1 to SF7 and an addressing period A8 of a subfield SF8 of a first field F1' of the next frame, and the first field F1' involves only maintenance discharge periods S81 to S87 of the subfield SF8. These periods S81 to S87 for the even display lines are the same as the maintenance discharge periods S1 to S7 in the subfields SF1 to SF7 for the odd display lines. The subfield SF8 involves the maintenance discharge periods S81 to S87 as well as suspension periods N1 to N8.

The maintenance discharge periods S1 to S7 and S81 to S87 of the subfields SF1 to SF8 involve different numbers of maintenance discharge cycles, and each of the maintenance discharge cycles causes a single discharge pulse between the X- and Y-electrodes. The numbers of maintenance discharge cycles in the subfields SF1 to SF8 are 4, 8, 16, 32, 64, 128, 256, and 508, respectively. Namely, a ratio thereof is 1:2:4:8:16:32:64:127. The 508 maintenance discharge cycles in the subfield SF8 are divided among the maintenance discharge periods S81 to S87 as 4, 8, 16, 32, 64, 128, and 256, respectively. Namely, the maintenance discharge periods S81 to S87 of the subfield SF8 for the odd (even) display lines have the same lengths, phases, and numbers of cycles as the maintenance discharge periods S1 to S7 of the subfields SF1 to SF7 for the even (odd) display lines. In the subfield SF8, no rewrite operation is carried out during the suspension periods N1 to N8, and, therefore, the maintenance discharge operations in the periods S81 to S87 are carried out according to the display data selectively written in the addressing period A8.

This method provides 255 different luminances, i.e., 255 intensity levels. Since the maintenance discharge is carried out on the odd and even display lines with the same phase, there is no need to provide separate driving circuits. Accordingly this method is achievable on conventional driving circuits.

Figure 12:
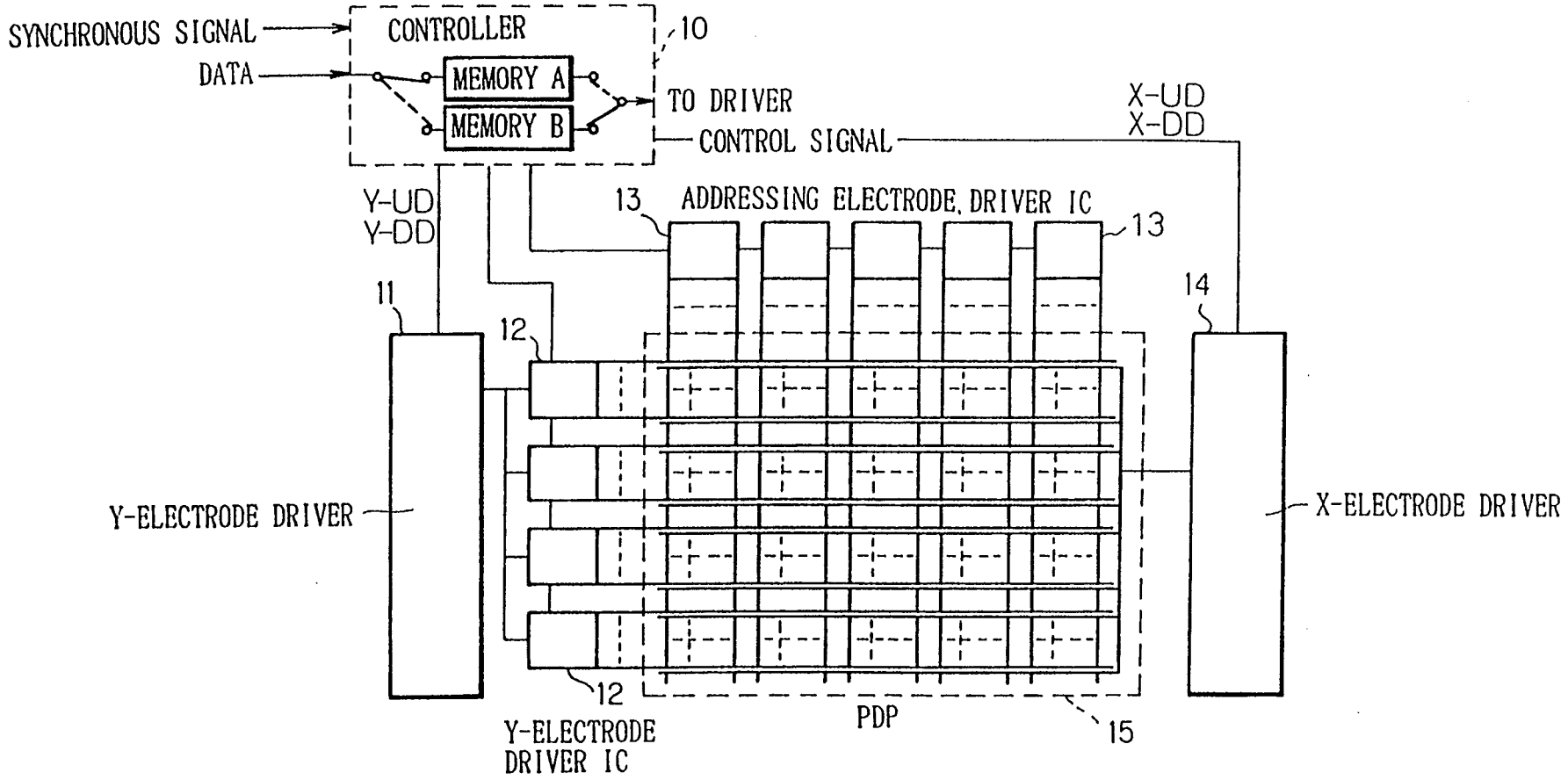
FIG. 12 shows a driver circuit employing the PDP driving method according to the present invention.

FIG. 12 shows a driving circuit employing the PDP driving method according to the present invention. In the figure, numeral 10 is a controller, 11 is a Y-electrode driver, 12 is a Y-electrode driver IC, 13 is an addressing electrode driver IC, 14 is an X-electrode driver IC, 15 is a PDP. The PDP 15 has the same arrangement as the one shown in FIGS. 1 and 2.

The controller 10 has two memories A and B to store externally supplied input signals. The controller 10 alternately reads the data stored in the memories A and B and supplies the data to the drivers to display the data. If the PDP 15 has 1000 display lines, the PDP driving method of the present invention writes data in a selected 500 of the 1000 lines in each addressing period.

Figure 13:
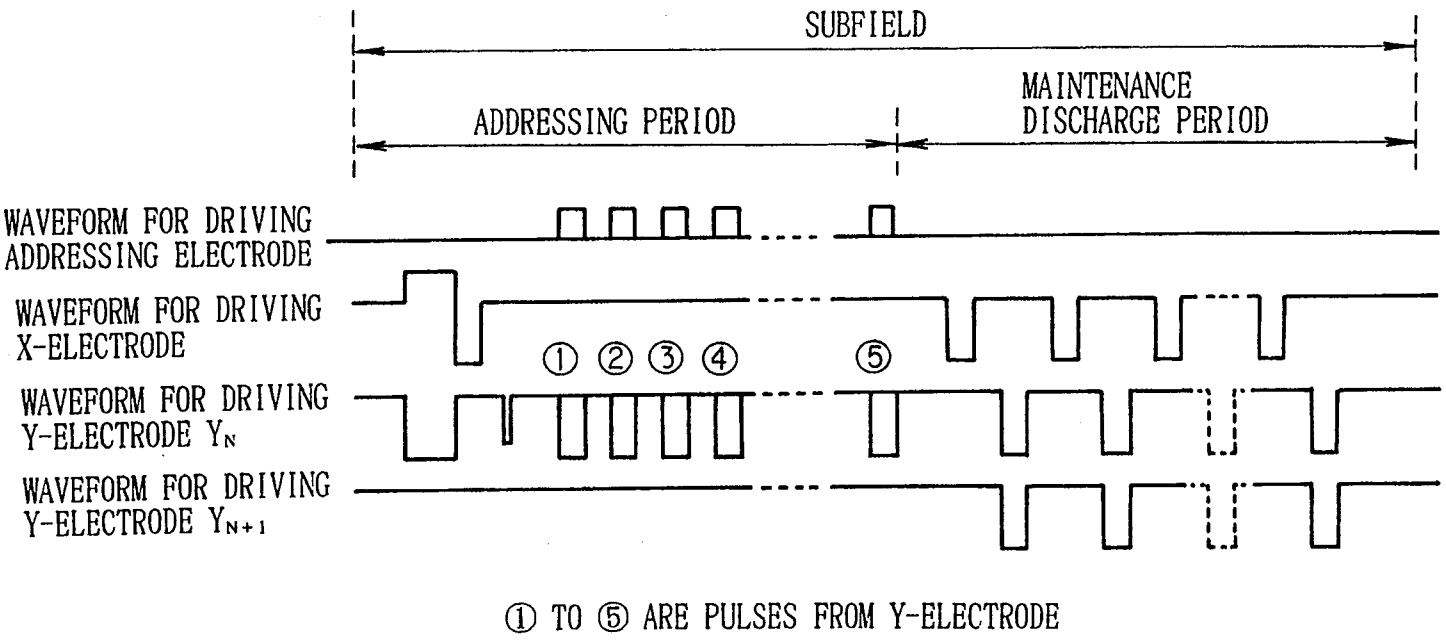
FIG. 13 shows examples of PDP driving waveforms according to the PDP driving method of FIG. 11.

FIG. 13 shows examples of PDP driving waveforms according to the PDP driving method of FIG. 11. At the start of an addressing period in each subfield, a total write/erase operation is carried out to set uniform conditions in every cell. This total write/erase operation is carried out on odd display lines in a first field and on even display lines in a second field. Thereafter, a selective write operation is carried out sequentially on the odd display lines in the first field and on the even display lines in the second field, to form wall charges in selected cells. After the addressing period, a maintenance discharge period follows.

In FIG. 13, a YN-electrode driving waveform is sequentially applied to the odd display lines in the first field and to the even display lines in the second field. The display lines that are not rewritten receive a YN+1-electrode driving waveform.

During the maintenance discharge period, the cells that have been rewritten in the addressing period are subjected to the maintenance discharge according to the newly written data. The cells that have not been rewritten are subjected to the maintenance discharge according to the display statuses in the previous subfield, to keep the previous statuses. For the even display lines for example, the maintenance discharge in the second subfield is carried out according to display data written in the last addressing period in the first field, i.e., the addressing period of the subfield SF8 having the highest luminance.

The quantity of the display data used for rewriting the odd display lines in the addressing periods A1 to A8 in the first field is half the quantity of data required by the conventional method. Namely, the present invention is achievable with a frame memory whose capacity is half the capacity of a conventional one.

According to the PDP driving method of this embodiment, eight subfields-are prepared to display 255 intensity levels. Here, the number of intensity levels (NGS) is expressed as follows:

$$NGS=2^N-1 \quad (1)$$

where N is the number of the subfields.

According to a standard intensity level display method that divides a frame into subfields, the number of intensity levels (NGS) is expressed as follows:

$$NGS=2^N \quad (2)$$

where N is the number of the subfields.

If there are eight subfields, 256 intensity levels are provided. The above embodiment, however, is one intensity level short because the number of maintenance discharge pulses in the first field is equal to that in the second field.

To provide 256 intensity levels as expressed in the equation (2), the number of maintenance discharge operations in the first field must differ from that in the second field. To achieve this, the subfields SF1 and SF2 may have the same number of maintenance discharge pulses and an erase pulse may be interposed in the maintenance discharge period in the subfield SF1, to suspend maintenance discharge. This example will be explained with reference to FIG. 14.

Figure 14:
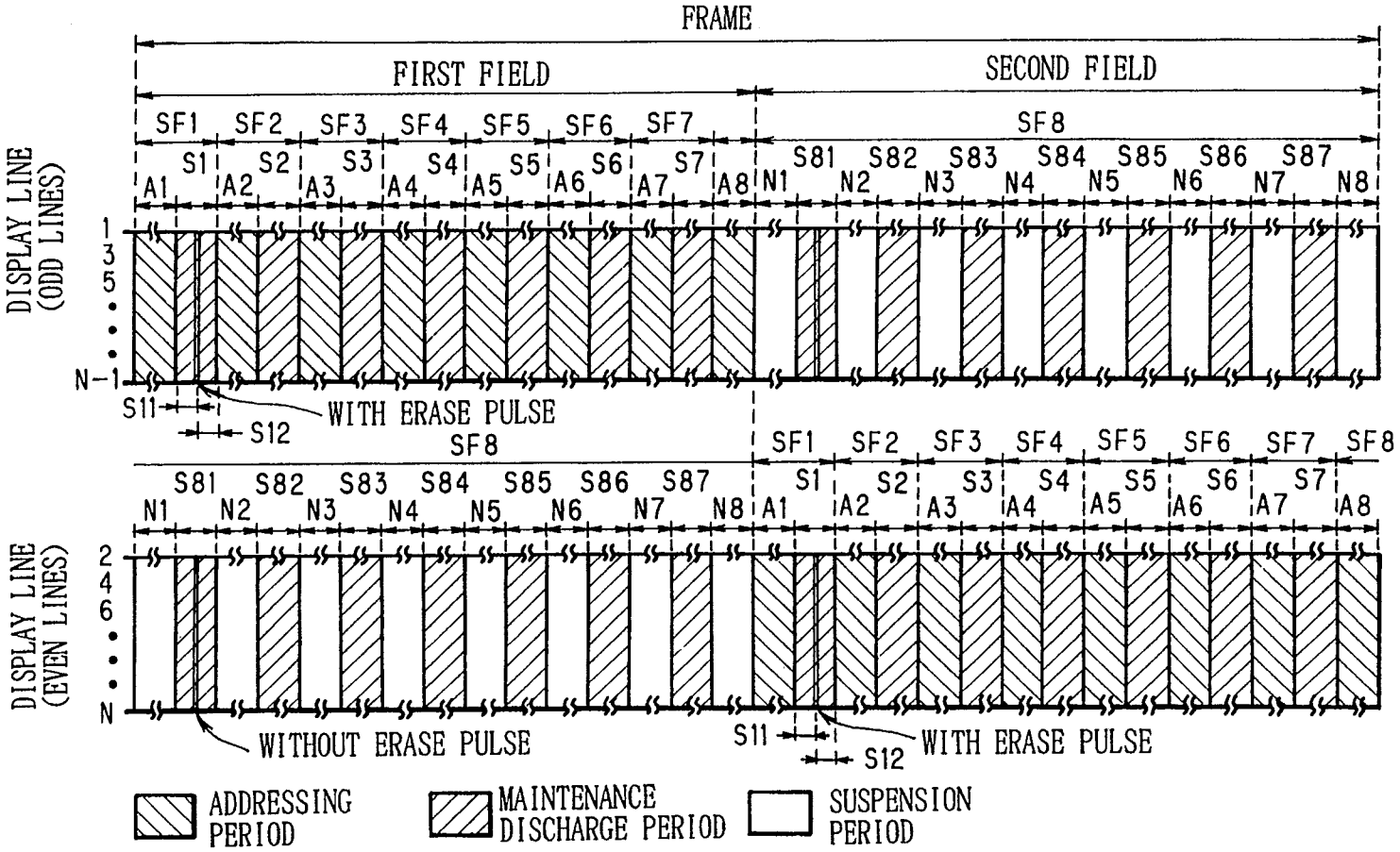
FIG. 14 is a timing chart explaining a PDP driving method according to another embodiment of the present invention.

FIG. 14 is a timing chart showing the PDP driving method according to another embodiment of the present invention. In the figure, a maintenance discharge period S1 in a subfield SF1 and a maintenance discharge period S2 in a subfield SF2 involve the same number of maintenance pulses. An erase pulse is inserted in the maintenance discharge period S1, to divide the period into a first half period S11 and a second half period S12. Actual discharge occurs only in the first half period S11, and the maintenance discharge in the second half period S12 becomes invalid. Accordingly, the number of actual maintenance discharge operations in the maintenance discharge period S1 in the subfield SF1 becomes half of that in the subfield SF2.

In a first maintenance discharge period S81 in a subfield SF8, no pulse is inserted while an erase pulse is inserted to suspend maintenance discharge in the corresponding subfield SF1, so that no erase discharge occurs in the period S81. Accordingly, maintenance discharge is repeated afterwards in the period S81 according to display data written in an addressing period A8.

As a result, a ratio of the maintenance discharge operations in the subfields SF1 to SF8 will be 1:2:4:8:=16:32:64:128, to provide 256 intensity levels as expressed in the equation (2).

Figure 15:
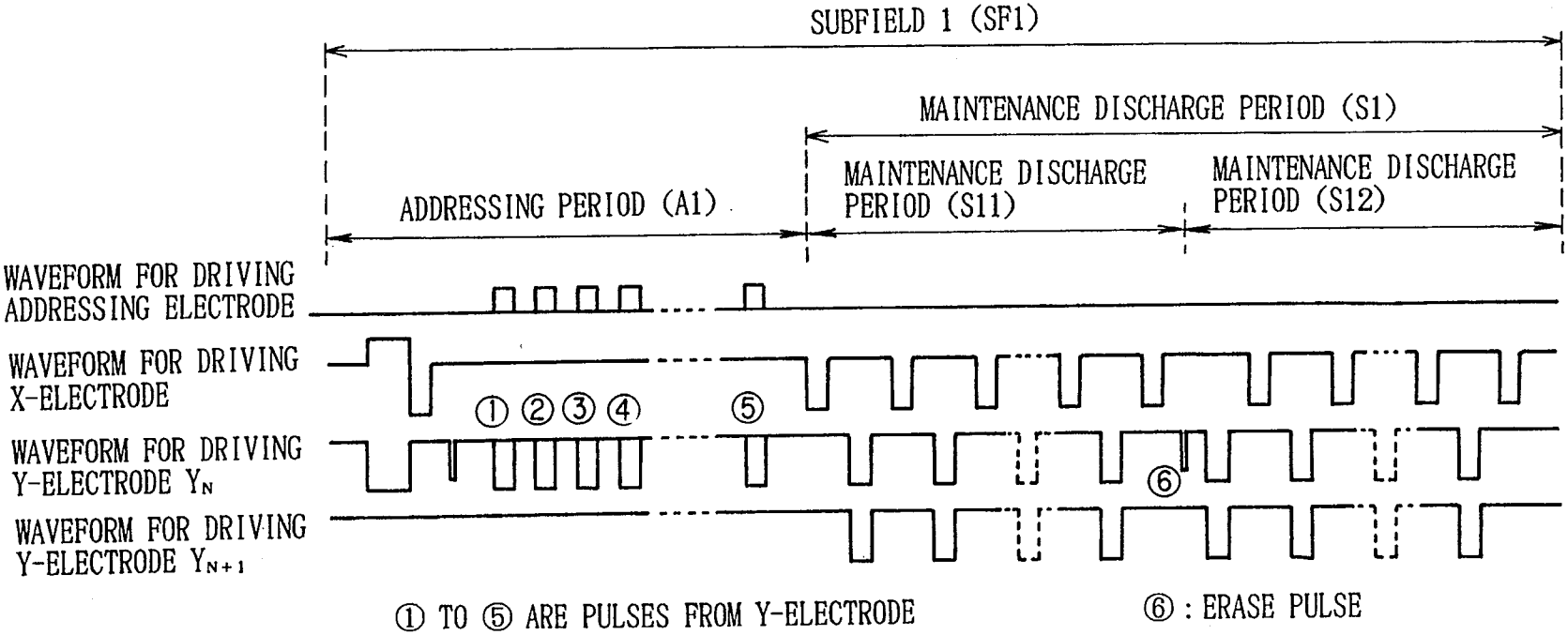
FIG. 15 shows examples of PDP driving waveforms according to the PDP driving method of FIG. 14.

FIG. 15 shows examples of PDP driving waveforms of the PDP driving method of FIG. 14. Maintenance discharge in the subfield SF1 is suspended due to an erase pulse. A YN-electrode driving waveform is applied to odd display lines in the subfield SF1 in the first field. A YN+1-electrode driving waveform is applied to even display lines in a corresponding period, i.e., a suspension period N1 plus a maintenance discharge period S81 in a subfield SF8.

In this way, the maintenance discharge period S1 in the subfield SF1 is divided into the first and second half periods S11 and S12. Just before the second half period S12, an erase pulse is inserted to decrease wall charges, to invalidate maintenance discharge. As a result,, maintenance pulses in the second half period S12 become ineffective. Although this embodiment is based on the selective write addressing method, it may be based on the conventional self-erase addressing method.

Figure 16:
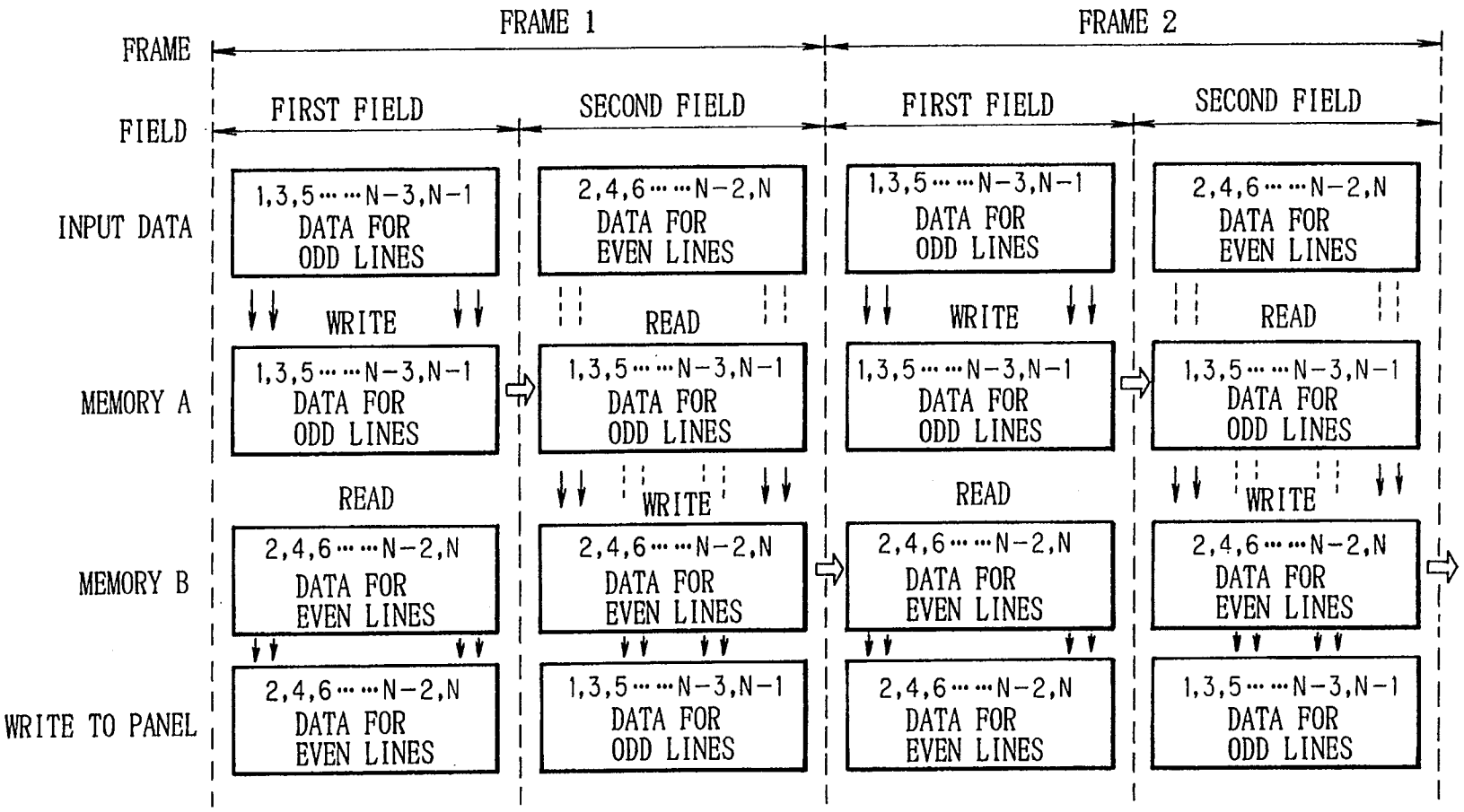
FIG. 16 shows an arrangement of memories that process display data according to the PDP driving method of the present invention.

FIG. 16 shows an arrangement of memories for processing display data according to the PDP driving method of the present invention. The memories A and B are arranged in, for example, the controller 10 of FIG. 12.

In FIG. 16, display data for odd display lines provided in a first field are written in the memory A. At the same time, display data for even display lines stored in the memory B are transferred to an addressing electrode driver and are displayed on the PDP. In a second field, display data for the even display lines are stored in the memory B, and the display data for the odd display lines are read out of the memory A and displayed on the PDP. Each of the memories A and B covers half of total display lines (N). Namely, the capacity of the memory according to the present invention is half of the capacity of a memory according to the prior art.

FIG. 17 is a block diagram showing a PDP driver according to the present invention. This figure corresponds to FIG. 12. In FIG. 17, numeral 10 is a controller, 11 is a Y-electrode driver, 12 is a scan driver (Y-electrode driver IC), 13 is an addressing electrode driver (an addressing electrode driver IC), 14 is an X-electrode driver, and 15 is a PDP.

The controller 10 includes a display data controller 20 and a panel controller 30. The display data controller 20 has a frame memory 21. The panel controller 30 has a scan driver controller 31 and a common driver controller 32. A reference mark "Clock" is an external dot clock signal representing display data, "Blnk" is a signal for indicating an effective period of the display data, "DATA" is the display data of three primary colors each with eight bits (3×8 bits in total) to display color images with 256 intensity levels, "Vsync" is a vertical synchronous signal indicating the start of a frame (a field), "Hsync" is a horizontal synchronous signal, and "Parity" is a signal indicating the polarity of the field.

The display data controller 20 stores display data in the frame memory 21 and transfers the display data A-DATA, a transfer clock A-CLK, and a latch signal A-LCH to the addressing electrode driver 13 according to the drive timing of the PDP 15. The panel driving controller 30 determines the timing for applying a high-voltage waveform to the PDP 15. The scan driver controller 31 provides scan data Y-DATA for turning ON the scan driver 12 bit by bit, a transfer clock Y-CLK for turning ON the scan driver 12 bit by bit, and strobe signals Y-STB1 and Y-STB2 for determining the timing of turning 0N the scan driver 12. The common driver controller 32 provides a signal X-UD for providing Vs/Vw to turn ON/OFF the X-electrode driver 14, a signal X-DD for turning ON/OFF (GND) the X-electrode driver 14, a signal Y-UD for providing Vs/Vw to turn ON/OFF the scan driver 12, and a signal Y-DD to turn ON/OFF (GND) the scan driver 12.

Figure 19:
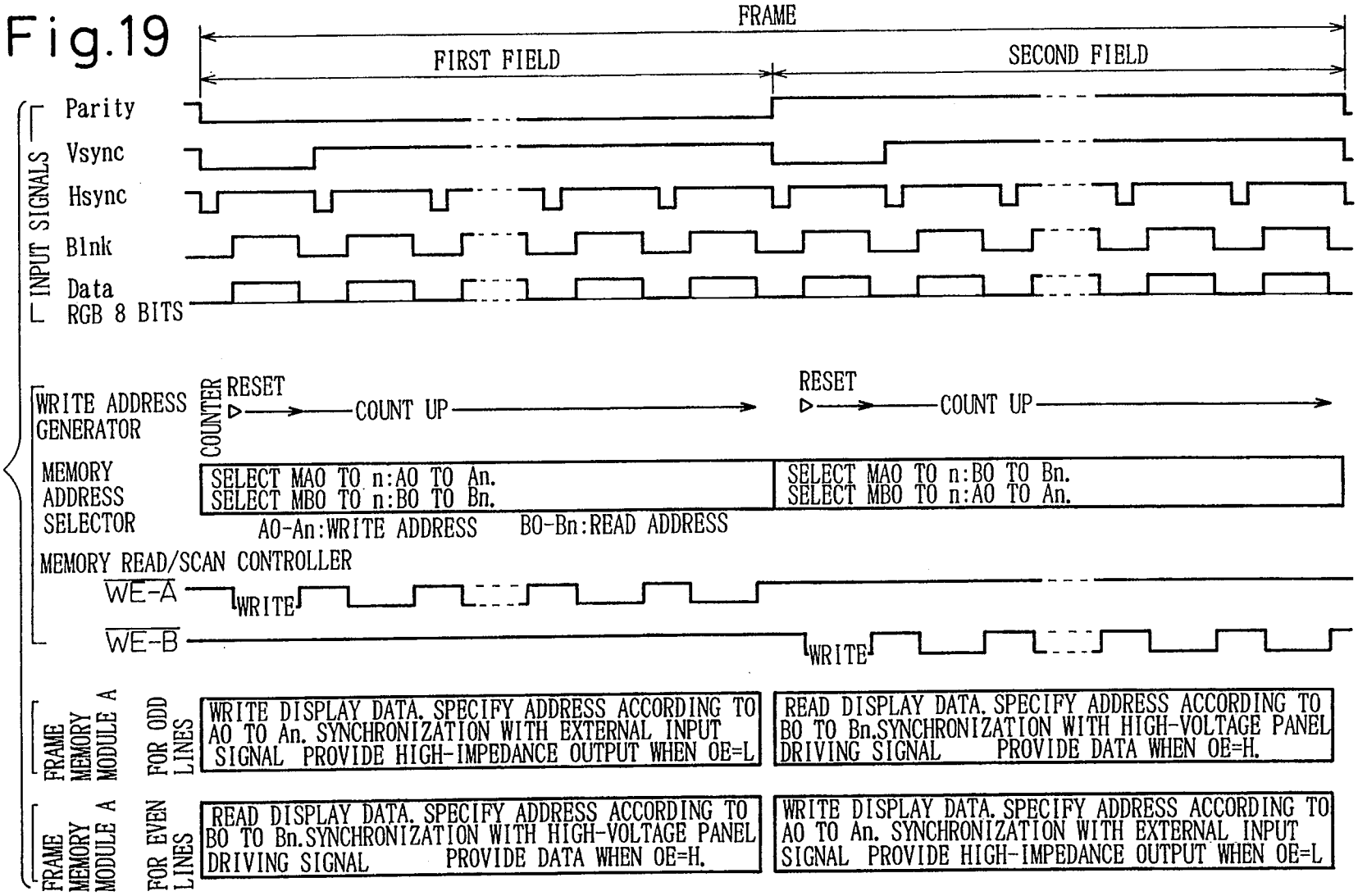
FIG. 19 is a timing chart explaining the operation of the display data controller of FIG. 18.
Figure 20:
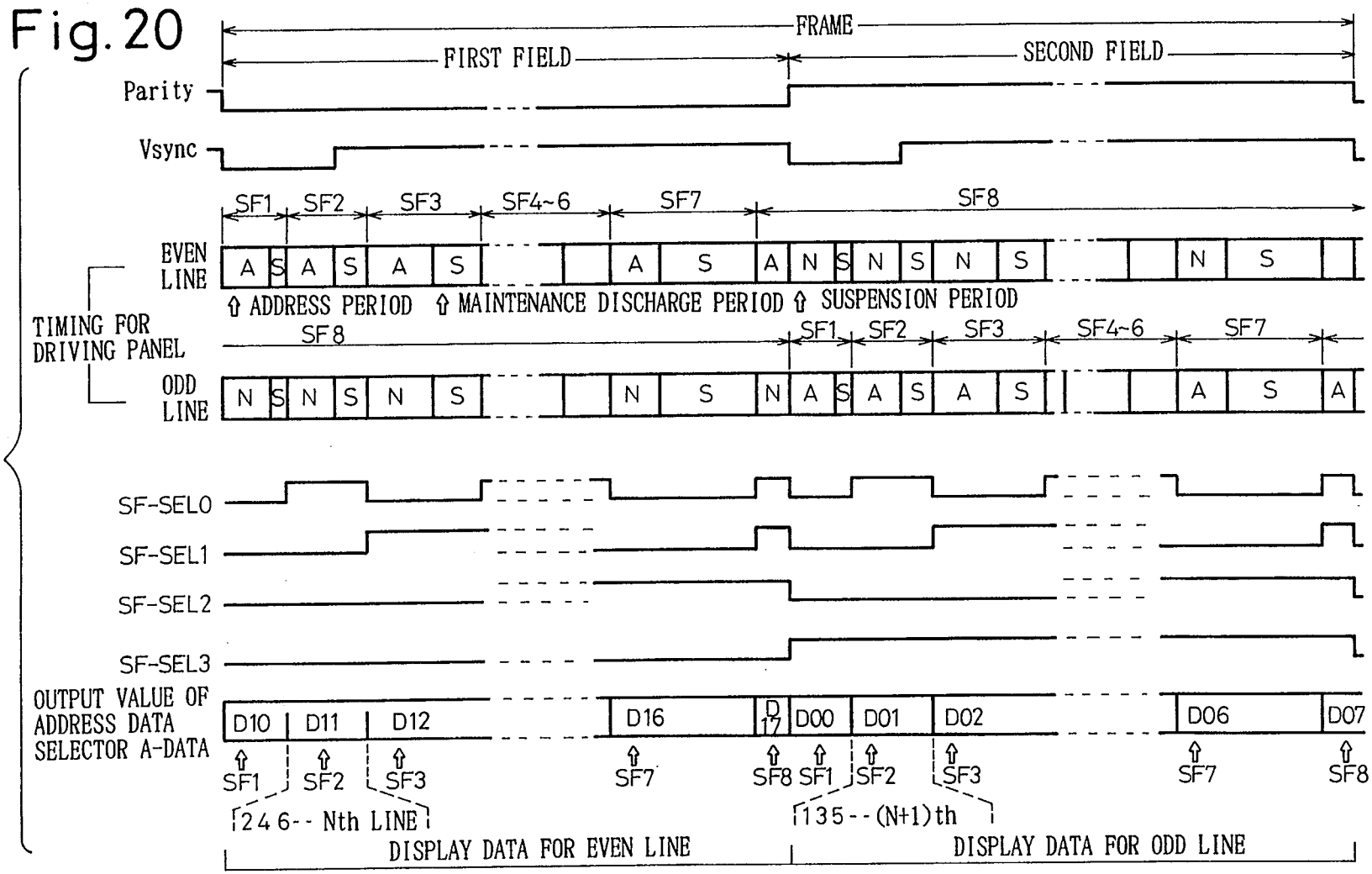
FIG. 20 is a timing chart explaining the operation of the PDP of FIG. 17.

FIG. 18 is a block diagram showing the display data controller 20 of the PDP driver of FIG. 17. FIG. 19 is a timing chart explaining the operation of the display data controller 20 of FIG. 18. FIG. 20 is a timing chart explaining the operation of the PDP driver of FIG. 17. These figures show the vertical synchronous signal Vsync, horizontal synchronous signal Hsync, polarity signal Parity, blanking signal Blnk, and dot clock signal Clock. To display color images with 256 intensity levels for each of three primary colors, each of the colors involves 8-bit data, i.e., 24 bits in total including bits R0 to R7 for red, bits G0 to G7 for green, and bits B0 to B7 for blue.

In FIG. 18, the display data controller 20 includes two frame memories 21A and 21B, a write address generator 22 having a counter, a read address generator 23 having a counter, an oscillator 24, a memory address selector 25, an RGB data converter 26, a memory read/scan controller 27, bus transceivers 28A and 28B, and an address data selector 29.

The write address generator 22 generates addresses when writing display data in the frame memories 21A and 21B, in synchronism with input signals. The read address generator 23 generates addresses when reading display data out of the frame memories 21A and 21B, in synchronism with high-voltage drive signals. The memory address selector 25 selects the write or read addresses. The RGB data converter 26 rearranges RGB pixel data into subpixel data for the display panel.

The memory read/scan controller 27 specifies a memory to and from which display data is written and read, according to a parity signal. The controller 27 provides a write enable signal WE of low level to put a corresponding memory in a write state. The memory read/scan controller 27 starts to drive the panel in response to the vertical synchronous signal Vsync and parity signal Parity and determines the periods of subfields and the duration of address and maintenance periods in the subfields. The memory read/scan controller 27 provides a transfer clock A-CLK and latch signal A-LCH for transferring data from the memory address selector 25 to the addressing electrode driver ;13; a transfer clock Y-CLK and latch signal Y-LCH for the scan driver 12; and control signals SF-SEL0 to SF-SEL3 indicating the conditions of the subfields and used to select data to be transferred to the addressing electrode driver 13.

The first frame memory 21A stores display data for a first field. The display data is stored in the frame memory 21A during the first field and is read out of the memory during a second field. The second frame memory 21B stores display data for the second field. This display data is stored in the frame memory 21B during the second field and is read out of the memory during a first field of the next frame.

The first bus transceiver 28A becomes active to write data D0 to D7 to the frame memory and transfer data from the RGB data converter 26 to the frame memory in the first field. When reading the frame memory, the first bus transceiver 28A provides a high-impedance output in the second field. On the other hand, the second bus transceiver 28B becomes active to write data D0 to D7 to the frame memory and transfer data from the RGB data converser 26 to the frame memory in the second field. When reading the frame memory, the second bus transceiver 28B provides a high-impedance output in the first field.

The address data selector 29 selects display data according to the control signals SF-SEL0 to SF-SEL3 and transfers the display data to the addressing electrode driver 13 and display panel 15 in synchronism with the address clock A-CLK.

As explained above in detail, the present invention scans every other display line of an AC PDP according to interlaced display signals (video signals) without producing new display data by line interpolation, thereby shortening the otherwise required addressing time. With this technique, the present invention assures stabilized operation in the PDP and sufficient driving cycle time, increases the number of maintenance discharge cycles to improve luminance, increase the number of addressing cycles to drive many lines, and increases the number of subfields to provide many intensity levels. The present invention, therefore, improves the performance of the AC PDP. In addition, the present invention reduces memories and line interpolation circuits, thereby reducing the cost of the AC PDP.

Many different embodiments of the present invention may be constructed without departing from the spirit and scope of the present invention, and it should be understood that the present invention is not limited to the specific embodiments described in this specification, except as defined in the appended claims.

What is claimed is:

1. A method of driving a three-electrode surface-discharge alternating-current plasma display panel having first and second maintenance discharge electrodes that are in parallel with one another and addressing electrodes that are orthogonal to said first and second maintenance discharge electrodes, said first maintenance discharge electrodes being connected to one another, said second maintenance discharge electrodes being independent of one another and corresponding to display lines that form a screen of the plasma display panel, and wherein wall charges accumulated in said panel serve as memory media, said method comprising:

writing display data to the screen in separate first and second periods, said first period being an addressing period in which wall charges are accumulated, according to the display data, to prepare for maintenance discharge and said second period being a maintenance discharge period in which the maintenance discharge is repeated thereby to emit light; and carrying out the accumulation of wall charges in said addressing period on every other display line and the maintenance discharge in said maintenance discharge period on every display line.

2. A method of driving a three-electrode surface-discharge alternating-current plasma display panel as claimed in claim 1, said method further comprising:

dividing a frame, which corresponds to the screen, into first and second fields; and selectively writing display data to odd display lines, in each addressing period, in said first field and to even display lines, in each addressing period, in said second field.

3. A method of driving a three-electrode surface-discharge alternating-current plasma display panel as claimed in claim 2, further comprising:

storing display data in memory means during said first field and, during said second field, reading the display data out of said memory means and writing the read data in discharge cells; and storing display data in said memory means during said second field and, during a first field of the next frame, reading the display data out of said memory means and writing the read data in said discharge cells.

4. A method of driving a three-electrode surface-discharge alternating-current plasma display panel as claimed in claim 2, further comprising defining subfields in said first field, except a subfield having the highest luminance, and defining said second field so as to cover said maintenance discharge periods of the subfield having the highest luminance.

5. A method of driving a three-electrode surface-discharge alternating-current plasma display panel as claimed in claim 2, further comprising:

writing, in said first field, display data in discharge cells and carrying out maintenance discharge in said first and second fields according to the written display data; and writing, in said second field, display data in the discharge cells and carrying out maintenance discharge in said second field and a first field of the next frame according to the written display data.

6. A method of driving a three-electrode surface-discharge alternating-current plasma display panel as claimed in claim 5, further comprising, in every display line, controlling the phase of a maintenance discharge voltage, applied in each maintenance discharge period in said first field, to be the same as the phase of a maintenance discharge voltage applied in each maintenance discharge period in said second field.

7. A method of driving a three-electrode surface-discharge alternating-current plasma display panel as claimed in claim 6, further comprising carrying out the maintenance discharge with the same maintenance discharge drive in said first and second fields, and producing the same number of applications of the maintenance discharge voltage in said first field as in said second field.

8. A method of driving a three-electrode surface-discharge alternating-current plasma display panel as claimed in claim 6, further comprising applying an erase pulse to carry out erase discharging only on the even or odd display lines, thereby to provide the even and odd display lines with different numbers of maintenance discharge operations.

9. A three-electrode surface-discharge alternating-current plasma display panel comprising:

first and second maintenance discharge electrodes provided in parallel with one another, said first maintenance discharge electrodes being connected to one another, and said second maintenance discharge electrodes being independent of one another and corresponding to display lines that form a screen of a plasma display panel, wall charges being accumulated in said panel to serve as memory media;

addressing electrodes provided in orthogonal relationship to said first and second maintenance discharge electrodes;

means for writing display data to the screen in separate first and second periods, said first period being an addressing period in which wall charges are accumulated according to the display data thereby to prepare for maintenance discharge, and said second period being a maintenance discharge period in which the maintenance discharge is repeated thereby to emit light; and means for carrying out the accumulation of wall charges in said addressing period on every other display line and the maintenance discharge in said maintenance discharge period on every display line.

10. A three-electrode surface-discharge alternating-current plasma display panel as claimed in claim 9, wherein said plasma display panel further comprises:

means for dividing a frame, which corresponds to the screen, into first and second fields; and means for selectively writing display data to odd display lines in each addressing period in said first field and to even display lines in each addressing period in said second field.

11. A three-electrode surface-discharge alternating-current plasma display panel as claimed in claim 10, wherein said plasma display panel further comprises:

means for storing display data in memory means during said first field and, during said second field, for reading the display data out of said memory means and writing the read data in discharge cells; and means for storing display data in said memory means during said second field and, during a first field of the next frame, for reading the display data out of said memory means and writing the read data in said discharge cells.

12. A three-electrode surface-discharge alternating-current plasma display panel as claimed in claim 10, wherein said means for writing further comprises means for defining subfields in said first field except a subfield having the highest luminance, and said second field covers said maintenance discharge periods of the subfield having the highest luminance.

13. A three-electrode surface-discharge alternating-current plasma display panel as claimed in claim 10, wherein said plasma display panel further comprises:

means for writing, in said first field, display data in discharge cells and carrying out maintenance discharge in said first and second fields according to the written display data; and means for writing, in said second field, display data in the discharge cells and carrying out maintenance discharge in said second field and a first field of the next frame according to the written display data.

14. A three-electrode surface-discharge alternating-current plasma display panel as claimed in claim 13, further comprising means, operative in every display line, for maintaining the phase of a maintenance discharge voltage applied in each maintenance discharge period in said first field to be the same as the phase of a maintenance discharge voltage applied in each maintenance discharge period in said second field.

15. A three-electrode surface-discharge alternating-current plasma display panel as claimed in claim 14, wherein the maintenance discharge is carried out with the same maintenance discharge driver in said first and second fields, and the number of applications of the maintenance discharge voltage in said first field being the same as that in said second field.

16. A three-electrode surface-discharge alternating-current plasma display panel as claimed in claim 14, wherein said plasma display panel device further comprises means for applying an erase pulse to carry out erase discharge only on the even or odd display lines, thereby to provide the even and odd display lines with different numbers of maintenance discharge operations.

* * * * *

UNITED STATES PATENT AND TRADEMARK OFFICE

CERTIFICATE OF CORRECTION

PATENT NO. : 5,436,634

DATED : July 25, 1995

INVENTOR(S) : KANAZAWA

It is certified that error appears in the above-indentified patent and that said Letters Patent is hereby corrected as shown below:

Col. 1, line 12, begin a new paragraph with "Flat display ...".

Col. 2, line 6, delete "also";
line 7, change "and storing" to --and also storing--.

Col. 5, line 39, change "6-18692" to --6-186927--.

Col. 7, line 47, change "accumulated to" to --accumulated, thereby--.

Col. 8, line 4, after "rewritten" delete ",";
line 19, change "reduced" to --required--.

Col. 9, line 12, after "N8" delete ",".

Signed and Sealed this

Nineteenth Day of December, 1995

*Attest:*

BRUCE LEHMAN

*Attesting Officer*

*Commissioner of Patents and Trademarks*